US007264326B2

(12) United States Patent
Kubo et al.

(10) Patent No.: US 7,264,326 B2
(45) Date of Patent: Sep. 4, 2007

(54) INKJET PRINTER

(75) Inventors: Tomoyuki Kubo, Nagoya (JP); Katsunori Nishida, Aichi-ken (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 297 days.

(21) Appl. No.: 11/138,945

(22) Filed: May 25, 2005

(65) Prior Publication Data

US 2005/0264609 A1 Dec. 1, 2005

(30) Foreign Application Priority Data

May 25, 2004 (JP) ..... 2004-154854
Jun. 3, 2004 (JP) ..... 2004-165795

(51) Int. Cl.
*B41J 29/38* (2006.01)

(52) U.S. Cl. ..... 347/17; 347/14

(58) Field of Classification Search ..... 347/17, 347/14, 19

See application file for complete search history.

(56) References Cited

U.S. PATENT DOCUMENTS 4,653,940 A 3/1987 Katsukawa
5,006,867 A * 4/1991 Koizumi et al. ..... 347/17
5,467,113 A * 11/1995 Ishinaga et al. ..... 347/17
5,610,638 A 3/1997 Courtney
5,617,122 A 4/1997 Numata et al.
6,076,916 A 6/2000 Kaneko

FOREIGN PATENT DOCUMENTS

| | | |
|---|---|---|
| JP | A-5-50658 | 3/1993 |
| JP | B2-6-35193 | 5/1994 |
| JP | A-8-230177 | 9/1996 |
| JP | A-9-239989 | 9/1997 |
| JP | B2-3205117 | 9/2001 |
| JP | B2-3311186 | 8/2002 |
| JP | B2-3323778 | 9/2002 |

* cited by examiner

*Primary Examiner*—Thinh Nguyen
(74) *Attorney, Agent, or Firm*—Reed Smith LLP

(57) ABSTRACT

There is disclosed an inkjet printer comprising: an inkjet printhead having an actuator and a plurality of nozzle rows each consisting of a plurality of nozzles through each of which a droplet of ink is ejected onto a recording medium by driving of the actuator; an IC chip having a drive circuit for outputting a drive signal to the actuator based on print data so that the ink droplet is ejected from the each nozzle in accordance with the drive signal; and a temperature-difference-responsive controller which increases a period of time taken for completing printing of a first amount when a difference in temperature between two places at least one of which is on the printhead exceeds a reference value, the temperature-difference-responsive controller not increasing the period of time when the difference does not exceed the reference value.

31 Claims, 30 Drawing Sheets

SPECIFICATION OF WAVEFORMS

| | WAVEFORM OF DRIVE SIGNAL | FORM OF EJECTED DROPLET | VOLUME OF DROPLET |
|---|---|---|---|
| LARGE DROPLET | A   |  | 30 pl |
| MEDIUM DROPLET | B   |  | 15 pl |
| SMALL DROPLET | C   |  | 5 pl |

FIG.14

INK CONSUMPTION COUNT AND THERMAL CONTROL COUNT

| | VOLUME OF INK DROPLET [pl] | INCREMENT IN INK CONSUMPTION COUNT | INCREMENT IN THERMAL CONTROL COUNT |
|---|---|---|---|
| LARGE DROPLET | 30 | 6 | 6 × a × b |
| MEDIUM DROPLET | 15 | 3 | 3 × a × b |
| SMALL DROPLET | 5 | 1 | 1 × a × b |

a : THERMAL COEFFICIENT  b : THERMAL CONTROL COUNT COEFFICIENT

FIG.15 a = 0.3、b = 0.2

| | INK CONSUMPTION [pl] | INCREMENT IN INK CONSUMPTION COUNT | INCREMENT IN THERMAL CONTROL COUNT |
|---|---|---|---|
| LARGE DROPLET | 30 × 50 | 6 × 50 | 6 × 50 × 0.3 × 0.2 |
| MEDIUM DROPLET | 15 × 50 | 3 × 50 | 3 × 50 × 0.3 × 0.2 |
| SMALL DROPLET | 5 × 50 | 1 × 50 | 1 × 50 × 0.3 × 0.2 |
| TOTAL | 2500 | 500 | 30 |

INKJET PRINTER

INCORPORATION BY REFERENCE

The disclosure of Japanese Patent Applications Nos. 2004-154854 and 2004-165795 are incorporated herein by reference in its entirety.

BACKGROUND OF THE INVENTION

1. Field of the Invention

The invention relates to an inkjet printer which performs recording by ejecting ink droplets from nozzles arranged in a nozzle surface onto a recording medium by driving an actuator, and more particularly to an inkjet printer including an IC chip having a drive circuit for driving an actuator and disposed near rows of nozzles.

2. Description of Related Art

In a conventional inkjet printer, drive signals transmitted to an actuator are modulated depending upon the temperature of an environment in which the printer rests or is used (hereinafter referred to as "an environmental temperature"), in order to prevent degradation in the print quality due to a variation in the temperature of ink supplied to be ejected from nozzles in the form of droplets. Further, there has been proposed in Japanese Patent Application Laid Open No. 9-239989, a method in which a value to which the temperature of an inkjet printhead will rise after printing is complete throughout a given unit print area defined in a recording medium is estimated or calculated before the printing is actually performed, based on print data indicative of an image to be printed within the print area, more specifically, the total number of dots constituting the image, and when the result of the calculation indicates that there is a possibility for degradation in the print quality, the printing is implemented with a part of the print data masked.

Meanwhile, there have been recently an increasing demand for increasing the density of arrangement of nozzles in the nozzle surface of an inkjet printhead, for enhancing the resolution at which images are printed, and a tendency of downsizing a carriage or head holder holding the inkjet printhead so as to miniaturize an inkjet printer as a whole. The enhancement in the resolution increases an amount of heat generated at the printhead, while the downsizing the head holder necessitates an arrangement where an IC chip (or a drive circuit for driving an actuator) which generates heat is disposed in the vicinity of the printhead. As a consequence, a variation in the temperature of the printhead occurs, namely, the temperature of the printhead varies from place to place depending upon the relative position with respect to the IC chip, that is, depending upon the distance from the IC chip. This variation in the temperature of the printhead may cause an undesirable variation in printing characteristics among the nozzles depending upon their position relative to the IC chip.

SUMMARY OF THE INVENTION

The present invention has been developed in view of the above-described situations, and it is an object of the invention to provide an inkjet printer capable of preventing an adverse effect of a variation in the temperature of an inkjet printhead among places each corresponding to a part of all nozzles on the print quality To attain the above object, the invention provides an inkjet printer comprising:

an inkjet printhead having an actuator, and a plurality of nozzle rows each consisting of a plurality of nozzles through each of which a droplet of ink is ejected onto a recording medium by driving of the actuator;

an IC chip having a drive circuit for outputting a drive signal to the actuator based on print data so that the ink droplet is ejected from the each nozzle in accordance with the drive signal; and a temperature-difference-responsive controller which increases a first period of time taken for completing printing of a first amount when a difference in temperature between two places at least one of which is on the printhead exceeds a reference difference value which is a reference value of the temperature difference between the two places, the temperature-difference-responsive controller not increasing the first period of time when the temperature difference does not exceed the reference difference value.

The temperature of the printhead, and the temperature difference between the two places at least one of which is on the printhead, vary correspondingly to an amount of heat generated at the IC chip and the actuator, which in turn corresponds to an amount of ink consumed. Thus, the temperature and its distribution or variation, and the ink consumption correlate. Further, the printing characteristics change with the temperature of the printhead. Hence, to keep the print quality of a part of an image, which part is printed by ejection of ink droplets from the nozzles located between the two places, within a desirable range, the temperature difference mentioned above should be sufficiently small.

Therefore, the reference difference value of the temperature difference between the two places at least one of which is on the printhead is predetermined as a threshold, and when it is determined that the temperature difference between the two places exceeds the reference difference value, the first period of time taken to complete the printing of the first amount is increased so as to increase the degree to which the printhead is cooled, in order to prevent degradation in the print quality due to variation in the temperature of the printhead.

The first amount of printing may correspond to a single side or page of recording medium, or a single raster or a predetermined number of rasters. It is noted that the term "raster" refers to a swath of printed data produced by one pass of the printhead. Meanwhile, the print data is constituted by a plurality of data units. Where the first amount corresponds to a single page of recording medium, the data unit corresponds to data for a single raster, or alternatively a plurality of rasters. Where the first amount corresponds to a predetermined number of rasters, the data unit corresponds to data for a raster, or alternatively rasters of a number smaller than the number of the rasters constituting the print data for the printing of the first amount.

Whether or not the temperature difference between the two places exceeds the reference difference value may be determined by detecting the temperatures of the two places by means of a temperature sensor. However, this is not essential. For instance, as described later, an ink consumption calculator which calculates an amount of ink consumed for completing the printing of the first amount may be employed so that the determination whether the temperature difference exceeds the reference difference value is made based on the result of the calculation. Alternatively, it may be adapted such that a variable changer which increases and decreases a variable associated with the temperature difference according to the ink consumption is employed, and it is determined whether the thus changed variable exceeds a reference value thereof which is associated with the above-mentioned reference difference value.

The reference difference value may be such that when an actual value of the temperature difference exceeds the reference difference value, the printed image suffers from an uneven print density perceivable by the eye, and when the actual value of temperature difference does not exceed the reference difference value, the printed image does not suffer from such an uneven print density. For instance, the uneven print density takes the form at least one of banding which is a band having a print density different from that of the other part of the image; and a white line which is a blank band produced by failure of ejection of ink droplets.

Preferably, the two places are both on the printhead. More preferably, the two places are determined such that when the temperature of the printhead becomes constant after continued printing, the temperatures of the two places are the highest and the lowest, respectively, in the printhead. However, as will be described later, the temperature difference between two places both on the printhead increases with decrease in the temperature of the environment in which the printhead is used, and therefore the two places may be determined such that only one of the two places is on the printhead and the other is located outside or off the printhead.

The first amount may correspond to a single page of recording medium, or alternatively a single raster or a predetermined number of rasters.

Where the print data is constituted by a series of data units, and the printing of the first amount is printing based on a plurality of data units, the temperature-difference-responsive controller may be adapted such that when the temperature difference exceeds the reference difference value, the temperature-difference-responsive controller (i) defers start of the next printing of the first amount, (ii) divides a delay time which should be applied to the printing of the first amount so that the printing of the first amount takes the first period of time, into a plurality of sub delay times, and defers start of printing based on each of the data units by the sub delay time, or (iii) increases the first period of time by printing a single raster by plural printing operations such that a fragment of the print data for the single raster is divided into a plurality of parts based on which the plural printing operations are respectively performed.

In the case where delay is applied more than once to the printing of the first amount, the delay time is distributed among the data units constituting the print data for the printing of the first amount, while where the printing of a single raster is performed by plural printing operations, the printing of the single raster is performed taking a longer time than where the printing of the single raster is performed by a single printing operation. In either case, the printing of the first amount is performed relatively smoothly with less noticeable intermission as compared to an arrangement where a single long delay is applied only once to the same total amount (i.e., the first amount) of printing. Therefore, the influence of the heat generated during the last printing of the first amount is inhibited from affecting the next printing of the same amount. Thus, an inkjet printer constantly capable of smooth printing is provided.

In addition to the temperature-difference-responsive controller, the inkjet printer may further comprise a temperature-responsive controller which increases a second period of time taken for completing printing of a second amount when the temperature of the printhead exceeds a reference temperature value which is a reference value of the temperature of the printhead, and does not increase the period of time when the temperature does not exceed the reference value.

Preferably, the inkjet printer according to this arrangement comprises a drive-signal changer for changing the drive signal, which is based on the print data, with a rise in the temperature of the printhead while the temperature of the printhead is lower than the reference value. The drive-signal changer is provided in view of the following fact. That is, the temperature of the ink rises with the rise in the temperature of the printhead, resulting in decrease in the viscosity of the ink. When the ink viscosity lowers, the drive signal should be changed (such that the drive voltage is decreased, for instance) to be adapted to the elevated temperature, in order to prevent degradation in the print quality.

Whether such a drive-signal changer is provided or not, degradation in the print quality can not be fully prevented, and the temperature of the printhead may exceed the reference value. When the temperature of the printhead exceeds the reference value, the period of time taken for completing the printing of the second amount is increased by the temperature-responsive controller, so that the temperature of the printhead does not exceed the reference value.

The first and second amounts may or may not be the same.

Usually, the degradation in the print quality due to increase in the temperature difference between the two places related to the printhead is not uniform with respect to the position in the printhead. For instance, in a case where a first one of the two places corresponds to nozzles belonging to the farthest one of all the nozzle rows from the IC chip while the second one of the two places corresponds to nozzles belonging to the nearest one of all the nozzle rows with respect to the IC chip, or in another case where a first one of the two places corresponds to nozzles the farthest from the IC chip in the respective nozzle rows while the second one of the two places corresponds to nozzles the nearest the IC chip in the respective nozzle rows, there can occur that the nozzles at the first place do not contribute to the degradation of the print quality but the nozzles at the second place do. However, the degradation in the print quality due to the rise in the temperature of the printhead occurs substantially concurrently throughout the printhead.

In general, the temperature of an environment in which the printhead is used, or the temperature inside the inkjet printer including the printhead, is relatively low when the temperature of the environment in which the inkjet printer is used is relatively low. Since the temperature inside the printer rises as the printer is kept operated, the temperature of the environment in which the printhead is used increases with the operating time of the printer to eventually reach a constant value, and then stays thereat. That is, the temperature difference related to the printhead tends to be relatively large when the temperature of the environment in which the printer is used is relatively low, and when the current printing operation is one after non-operation of the printer for a long time, and performed at a relatively high dot ratio from the beginning of the printing operation.

Thus, the temperature-difference-responsive controller increases the period of time taken for completing the printing of the first amount when the temperature of the environment in which the inkjet printer is used is relatively low, and/or when the inkjet printer starts printing after non-operation for a long time and continues the printing at a relatively high dot ratio, while the temperature-responsive controller increases the period of time taken for completing the printing of the second amount when the temperature of the environment in which the printer is used is relatively high, and/or when the printer has been kept operating for a relatively long time.

Where the print data is constituted by at least one data unit, and the printing of the first amount is performed based on the at least one data unit, the temperature-difference-responsive controller may comprise: a consumption calculator which calculates an ink consumption which is an amount of ink consumed for completing the printing of the first amount; and a consumption-responsive deferrer which defers start of printing based on at least one of the at least one data unit constituting the print data for the printing of the first amount, when the ink consumption calculated by the consumption calculator takes such a value that indicates that the period of time taken for completing the printing of the first amount should be increased.

Preferably, the IC chip is disposed on one of opposite sides of the nozzle rows in a direction perpendicular to a direction of extension of each of the nozzle rows, and the consumption-responsive deferrer implements the deferring when the ink consumption calculated by the consumption calculator exceeds a reference consumption value which is a reference value of the ink consumption, the reference consumption value being such that when the printing of the first amount which consumes the ink of the reference consumption value is repeated, a difference in temperature between a third place and a fourth place, as the two places saturates at the reference difference value, the third place corresponding to one of the nozzle rows which is the nearest the IC chip among all the nozzle rows while the fourth place corresponding to another of the nozzle rows which is the farthest from the IC chip.

When the printhead is segmented into parts corresponding to the respective nozzle rows, the temperatures of the segments differ from one another depending upon their position relatively to the IC chip which generates heat, and upon the state of driving of the IC chip. Namely, the temperature difference among the segments is maximum between a segment corresponding to the nozzle row which is adjacent to or the nearest the IC chip and another segment corresponding to the nozzle row which is the farthest from the IC chip. In other words, the temperature difference in the printhead is maximum between two places respectively corresponding to the nozzle rows which are the nearest and the farthest with respect to the IC chip. The temperature of the printhead changes with the ink consumption, i.e., the amount of ink as consumed as a result of the driving of the IC chip, and the above-mentioned temperature difference changes as well. Thus, the temperature and its distribution or variation, and the ink consumption correlate. Further, the printing characteristics changes with the temperature. Therefore, when the print quality of a part of an image which part is printed by ink droplets ejection from the nozzles located between the two places corresponding to the nearest and farthest nozzle rows is at a satisfactory level, the temperature difference between any two of the other places corresponding to the other nozzle rows is within a range which does not lower the print quality of the image.

Thus, in the printer according to the above-described preferred arrangement, a reference value of the temperature difference between two of the segments or places respectively corresponding to the nozzle rows is predetermined. The difference in printing characteristics attributable to the temperature difference is the largest between the two places among all the places. That is, one of the two places corresponds to the nozzle row the nearest the IC chip while the other of the two places corresponds to the nozzle row the farthest from the IC chip. Then, the start of printing based on at least one of the at least one data unit constituting the print data for the printing of the first amount is deferred, when an amount of ink which has been actually consumed, or an amount of ink to be consumed immediately subsequently, exceeds a reference consumption value which is a reference value of the ink consumption, thereby cooling the printhead greatly.

That is, the consumption calculator may be adapted to calculate (i) an amount of ink which has been consumed in the last printing of the first amount, immediately after the last printing, or (ii) an amount of ink which is estimated to be consumed in the next or immediately subsequent printing of the first amount. Strictly, in the former, the consumption-responsive deferrer starts the subsequent printing when the temperature difference in question is sufficiently lowered by the deferring by a delay time according to the amount of the heat generated during the last printing. In the latter, the consumption-responsive deferrer calculates or estimates an amount of heat which will be generated during the next printing and defers the start of the next printing by a delay time according to the estimated heat amount, so that the next printing is started when the temperature difference in question is lowered to some degree. It is noted, however, that generally an amount of change in the temperature difference produced during each printing of the first amount is relatively small, and the same effect can be obtained in the both cases.

The heat at the IC chip is transmitted to the printhead mainly through a cable (commonly, a flexible flat cable) electrically connecting the IC chip with the printhead, but also by radiation and via the atmospheric air.

The smaller the distance between the IC chip and the nozzle row which is the nearest the IC chip, the more meaningful the invention is. More specifically, when the length of a part of the cable extending between the IC chip and the nearest nozzle row is less than 20 mm, the invention is meaningful. When the length is less than 15 mm, the invention is especially meaningful, and when the length is less than 10 mm, the invention is further meaningful. In other words, the invention is meaningful when a direct distance between the IC chip and the nearest nozzle row is smaller than 14 mm, which is less than twice an interval d between each adjacent two nozzle rows, and particularly when the direct distance is smaller than 10 mm, which is less than 1.5 times the interval d. The invention is further meaningful when the direct distance is smaller than 7 mm, which is less than the interval d.

The temperature difference in the printhead tends to occur particularly in an inkjet printer in which the nozzle rows extend parallel to each other and the IC chip is elongate and extends substantially parallel to one of the two outermost nozzle rows, that is, one of the two nozzle rows located at the opposite ends of the alignment of the nozzle rows. Accordingly, the invention is particularly meaningful when the invention is applied to such an inkjet printer.

When the IC chip extends substantially parallel to one of the two outermost nozzle rows, the temperature difference in the printhead is the largest between a part corresponding to a central portion of the nozzle row the nearest or adjacent to the IC chip, and a part corresponding to an uppermost stream side portion, with respect to the ink supply, of the nozzle row the farthest from the IC chip.

Hence, as places accurately exhibiting the largest difference in printing characteristics in the printhead due to temperature difference, there are selected a place corresponding to the nozzle or nozzles located at the central portion of the nozzle row adjacent to the IC chip, and a place corresponding to the nozzle or nozzles at the uppermost stream portion of the nozzle row the farthest from the IC chip, and the reference temperature difference as a reference value of the temperature difference is predetermined with respect to these two places. In an actual operation of the printer, the reference difference value is used with taking into consideration the amount of ink actually having been consumed, or the amount of ink to be consumed. That is, the period of time taken for completing the printing of the first amount is increased based on the ink consumption so as to increase the degree to which the printhead is cooled.

The temperature-difference-responsive controller may comprise: a variable changer which changes a variable associated with the temperature difference between the two places, based on at least an amount of ink consumed for completing the printing of the first amount; and a variable-responsive controller which increases the period of time taken for completing the printing of the first amount when the variable changed by the variable changer exceeds a reference value thereof which is associated with the reference difference value.

Preferably, the variable changer is adapted to increase the variable according to the ink consumption necessitated for the printing of the first amount, and decrease the variable according to an amount of the increase in the period of time by the temperature-difference-responsive controller.

The employment of such a variable enables evaluation of not only an increase in the temperature difference between the two places due to consumption of a relatively large amount of ink during the printing of the first amount, but also a decrease in the temperature difference due to (i) consumption of a relatively small amount of ink during the printing, (ii) application of a delay or deferring to the printing, (iii) suspension of the printing, or others. Thus, compared to a case where the delay time is determined directly based on the ink consumption, the above-described arrangement facilitates prevention of the degradation in the print quality, and inhibits lowering in the printing efficiency, at the same time.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 12 shows a relationship between a temperature of the environment in which the printer is used or rests, and a temperature coefficient a;

FIG. 14 shows a relationship among the volume of ink droplets, the increment in the ink consumption count, and the increment in the thermal control count;

FIG. 15 represents a specific example of the relationship of FIG. 14;

DETAILED DESCRIPTION OF PREFERRED EMBODIMENTS

Figure 1:
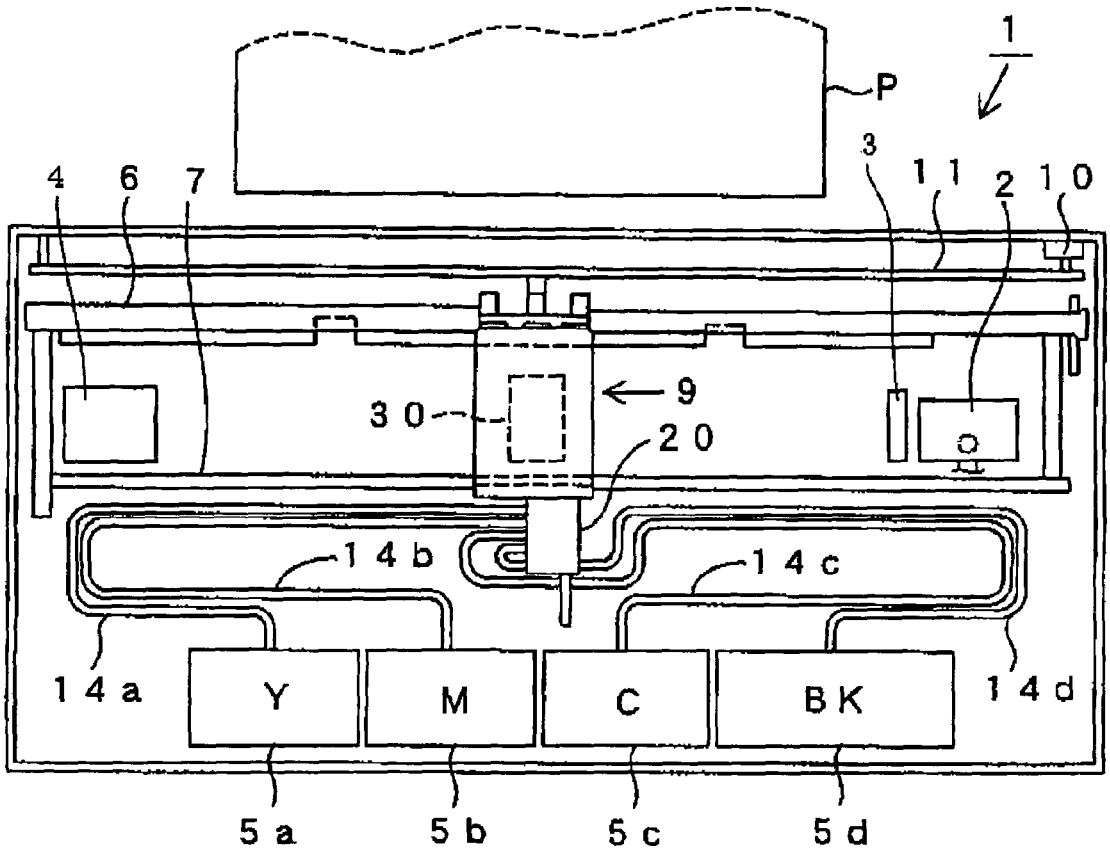
FIG. 1 is a plan view illustrating a general structure of an inkjet printer according to a first embodiment of the invention.

Hereinafter, there will be described presently preferred embodiments of the invention, referring to the accompanying drawings. Throughout the description of the embodiments, the same reference numerals denote the same parts or elements, even when not explicitly stated as such.

First Embodiment

Referring first to FIGS. 1-8, there will be described an inkjet printer according to a first embodiment of the invention.

<General Structure of Inkjet Printer>

Initially, there will be described a general structure of an inkjet printer according to a first embodiment of the invention, by referring to FIG. 1 which is an explanatory plan view of the inkjet printer.

In FIG. 1, reference numeral 1 denotes the inkjet printer, in which are incorporated two guide rods 6, 7, on which is movably supported a head holder 9 serving as a carriage. The head holder 9 holds an inkjet printhead 30 which performs printing by ejecting ink droplets onto a sheet P of paper as a recording medium. The head holder 9 is connected to an endless belt 11 circulated by a carriage motor 10. By driving the carriage motor 10, the head holder 9 is reciprocated along the guide rods 6, 7 in a main scanning direction.

The inkjet printer 1 further comprises ink tanks 5*a*, 5*b*, 5*c*, 5*d* respectively containing inks of yellow, magenta, cyan, and black. The ink tanks 5*a*-5*d* are connected to a tube joint 20 via flexible tubes 14*a*, 14*b*, 14*c*, 14*d*, respectively. At the leftmost position in a reciprocation range of the head holder 9, there is disposed an absorbing member 4 for absorbing bad ink as discharged from nozzles 33 in a flushing operation. On the other hand, at the rightmost position in the reciprocation range of the head holder 9, there is disposed a purging device 2 for sucking bad ink in the printhead 30 from the nozzles 33 in a purging operation. To the left of the purging device 2 is disposed a wiper 3 for wiping off ink adhering to a nozzle surface 31*a* of the print head 30. The nozzles 33 are arranged in the nozzle surface 31*a*.

<General Structure of the Head Holder>

There will be described a general structure of the head holder 9, referring to FIGS. 2 and 3.

Figure 2:
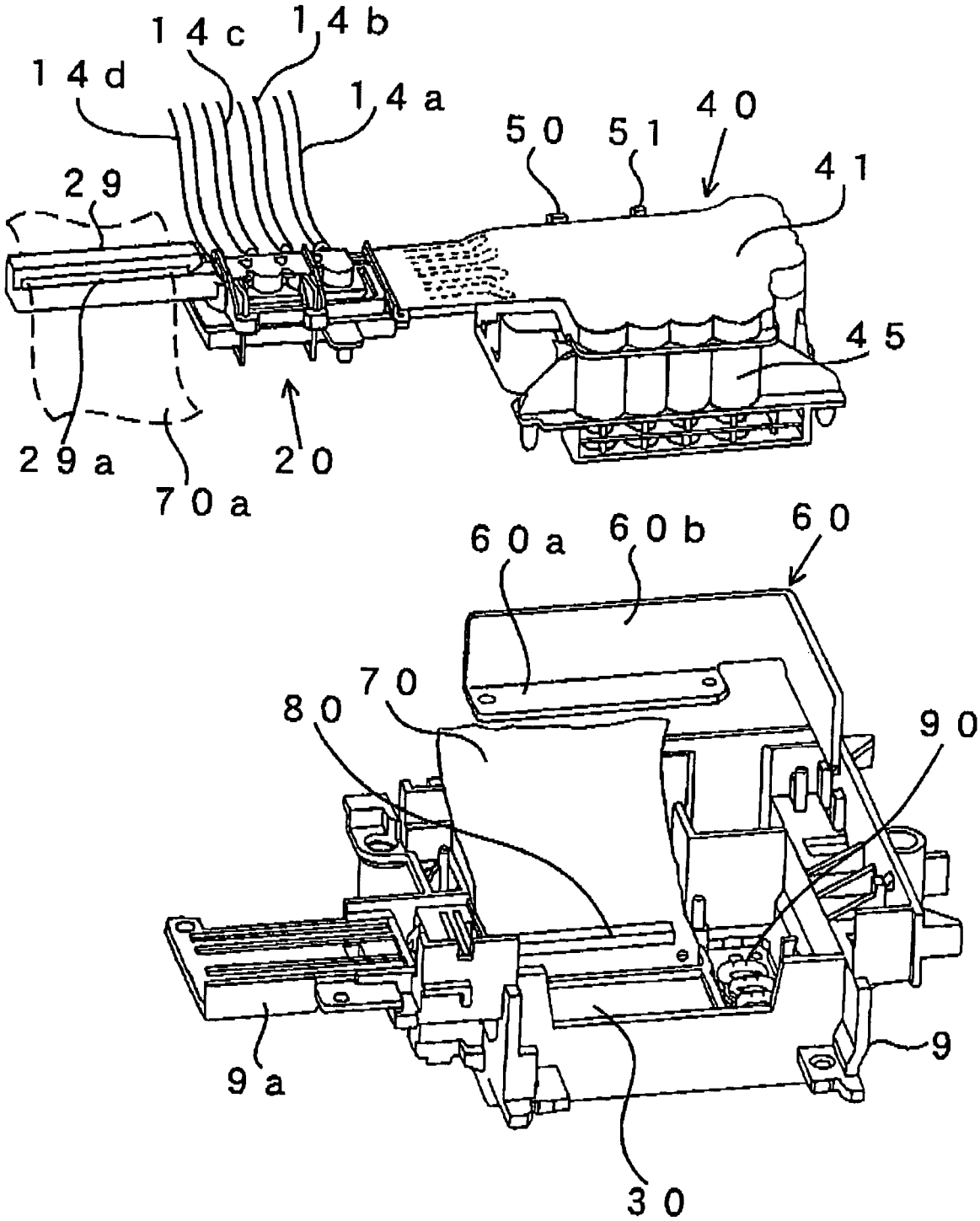
FIG. 2 is a perspective view illustrating a state where a buffer tank and a heatsink are removed from a head holder of the inkjet printer.
Figure 3:
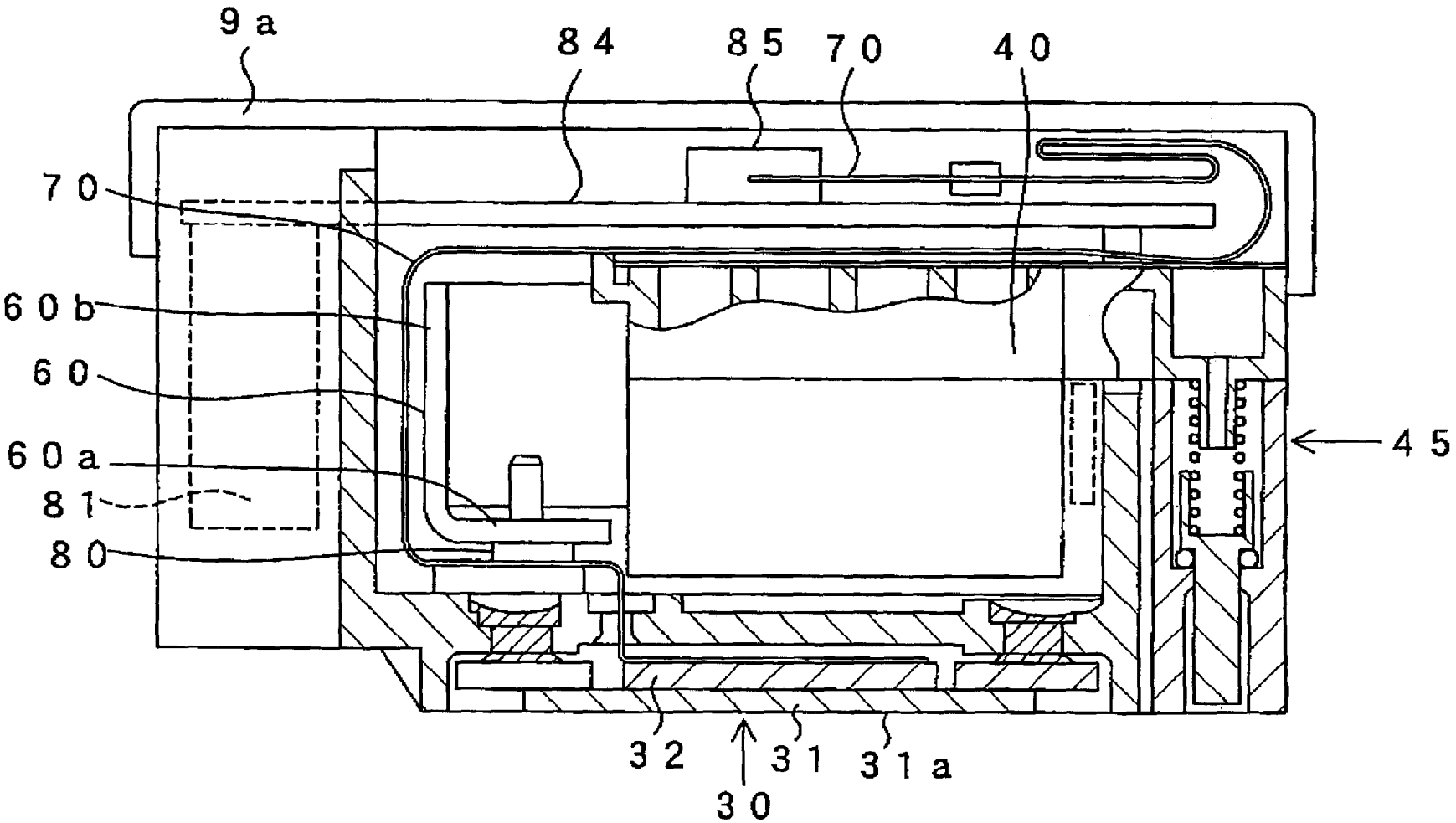
FIG. 3 is a through view of the head holder as seen from the left side.

FIG. 2 is a perspective view showing a state where a buffer tank 40 and a heatsink 60 are removed from the head holder 9, while FIG. 3 is an explanatory cross-sectional view of the head holder 9 as seen from the left side.

As shown in FIG. 3, on the bottom of the head holder 9, there is disposed the printhead 30 with its nozzle surface 31*a* exposed to the outside of the head holder 9. Over the printhead 30, there is disposed the buffer tank 40 for storing inks to be supplied to the printhead 30. As shown in FIG. 2, the tube joint 20 for supplying inks into the buffer tank 40 is disposed at an end of the buffer tank 40. On an underside of the buffer tank 40 are formed ink outlet ports 40*a*, 40*b*, 40*c*, 40*d* (only 40*a* is shown), which are respectively connected to ink supply ports 30*a*, 30*b*, 30*c*, 30*d* formed on an upper surface of the printhead 30, as shown in FIG. 4, via a sealing member 90 shown in FIG. 2.

A circuit board 84 is disposed over the buffer tank 40. The head holder 9 further comprises a cover 9*a* disposed over the circuit board 84. The heatsink 60 comprises a contact part 60*a* whose undersurface contacts an upper surface of the IC chip 80, and a side part 60*b* extending upward from an edge of the contact part 60*a* on the outer side. Each of the contact part 60*a* and the side part 60*b* is formed in an elongate planar shape, and an internal surface of the side part 60*b* is opposed to a longitudinal side face of the buffer tank 40. Between the side part 60*b* and a side wall of the head holder 9 is defined a space for accommodating a condenser 81 which protrudes from an undersurface of the circuit board 84. To the right of the buffer tank 40 is disposed an air discharging device 45 for discharging the air accumulated in the buffer tank 40, to the outside.

A flat cable 70 is disposed to be electrically connected to the IC chip 80 at one of its opposite ends, and extend through a clearance between the side part 60*b* and the side wall of the head holder 9 to be electrically connected to a connector 85 disposed on the circuit board 84 at it's the other end. The connector 85 is electrically connected to a control circuit including a CPU 57 shown in FIG. 5.

Figure 4:
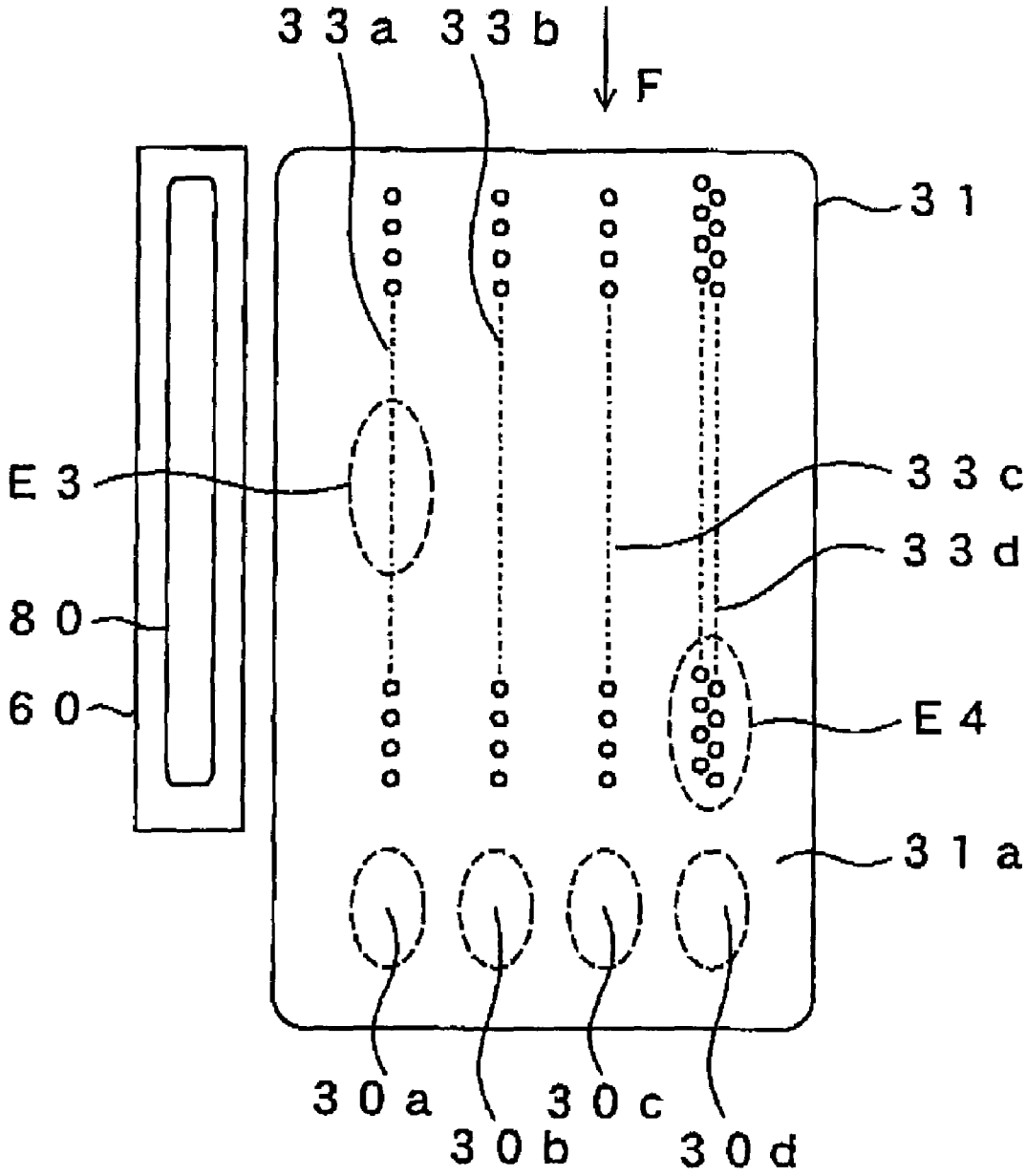
FIG. 4 is a bottom view as seen from the side of a nozzle surface of an inkjet printhead, showing a positional relationship between the printhead and an IC chip.

There will be now described how the printhead 30 and elements therearound are arranged in the present embodiment, by referring to FIGS. 3 and 4. FIG. 4 is a schematic bottom view of the printhead 30 as seen from the side of its nozzle surface 31*a* in which the nozzles 33 are arranged, and shows a positional relationship between the IC chip 80 and the printhead 30.

As shown in FIG. 4, the printhead 30 has a generally rectangular shape, and has the nozzle surface 31*a* in which a plurality of nozzles 33 are arranged in a plurality of nozzle rows 33*a*-33*d*. That is, a nozzle row 33*a* comprising a plurality of nozzles 33 for ejecting yellow ink, a nozzle row 33*b* comprising a plurality of nozzles 33 for ejecting magenta ink, a nozzle row 33*c* comprising a plurality of nozzles 33 for ejecting cyan ink, and two nozzle rows 33*d* each comprising a plurality of nozzles 33 for ejecting black ink, are disposed at intervals in the order of description from left to right as seen in FIG. 4. Although the nozzle row 33*d* for black ink actually consists of two nozzle rows, as stated above, these two rows of black ink will be hereinafter referred to as a single "nozzle row 33*d* for black ink", for simplicity. On the upperstream side of the nozzle rows 33*a*-33*d* with respect to supply of the inks, there are formed ink supply ports 30*a*-30*d* at respective positions corresponding to the nozzle rows 33*a*-33*d*. Through the ink supply ports 30*a*-30*d*, the inks stored in the buffer tank 40 are supplied to the inside of the printhead 30, namely, to the respective nozzle rows 33*a*-33*d*.

In the vicinity of the printhead 30 and at the side of the nozzle row 33*a* for yellow ink, which is one of the two outermost nozzle rows, there is disposed the IC chip 80, which generates heat. The IC chip 80 extends along a direction of extension of the nozzle row 33*a*. As shown in FIG. 3, the heatsink 60 for releasing the heat generated at the IC chip 80 is disposed in contact with the upper surface of the IC chip 80.

The printhead 30 comprises a cavity unit 31 in which fluid passages are formed, and a piezoelectric actuator 32 fixed on an upper face of the cavity unit 31. A plurality of ink chambers filled with the inks are formed in the cavity unit 31, while a plurality of nozzles 33 are open in the nozzle surface 31*a* constituted by an undersurface of the cavity unit 31. Each of the nozzles 33 communicates with a corresponding one of the ink chambers, thereby forming a plurality of continuous fluid passages connecting the ink supply ports 30*a*-30*d* upperstream of the nozzle rows 33*a*-33*d* to the individual nozzles 33 via the ink chambers. Upon driving of the piezoelectric actuator 32, the inks are ejected from the nozzles 33. The piezoelectric actuator 32 is electrically connected via the flat cable 70 to the IC chip 80 adjacent to the printhead 30.

<General Structure of Control System>

Figure 5:
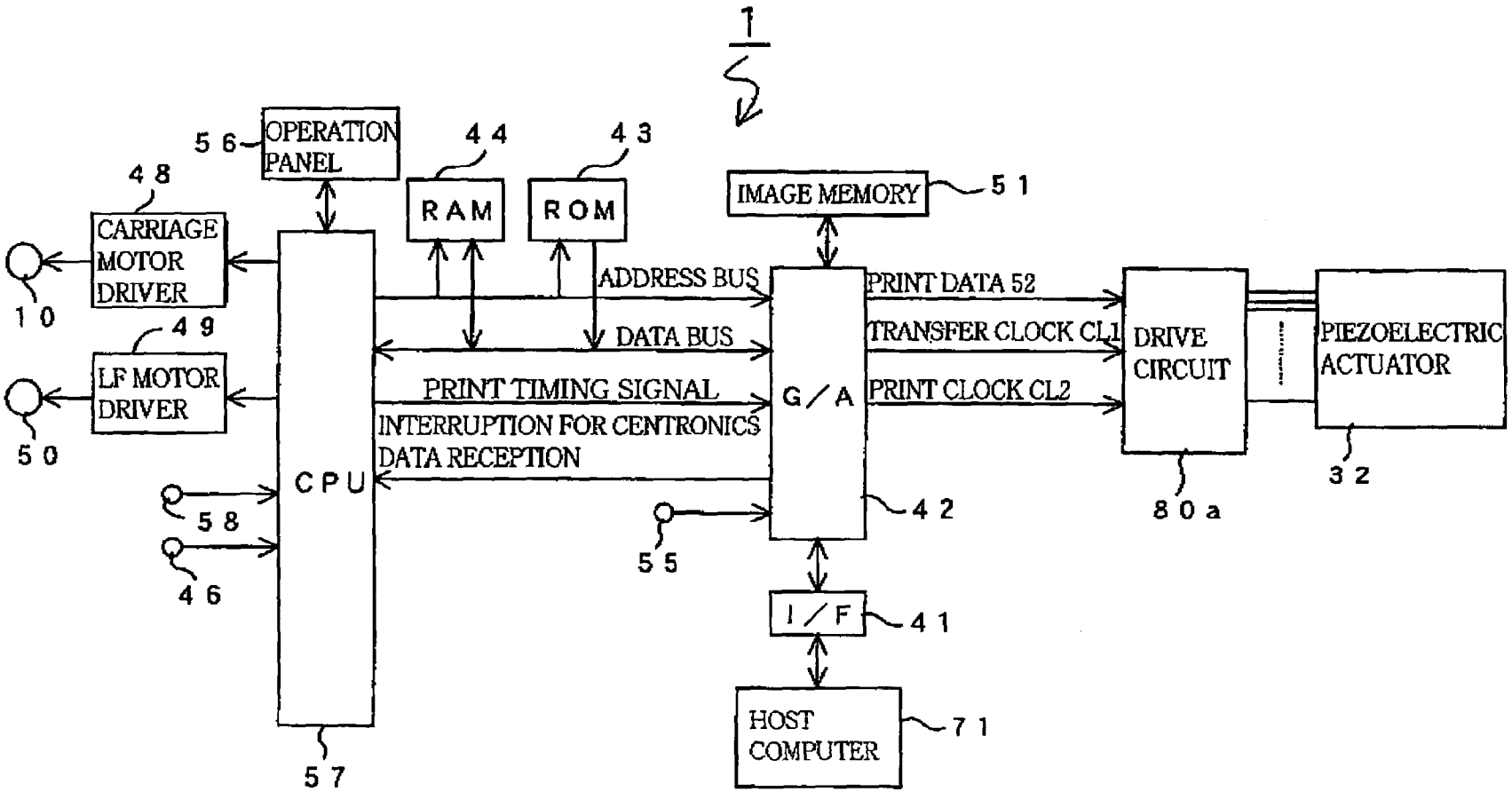
FIG. 5 is a block diagram showing a general structure of a control system of the inkjet printer.

There will be described a general structure of a control system of the inkjet printer 1, by referring to FIG. 5 where the general structure is presented in a block diagram.

The inkjet printer 1 comprises the CPU 57 and a gate array (G/A) 42. The CPU 57 implements general control operations necessary for performing printing. For instance, the CPU issues instructions regarding the printing to the drive circuit 80*a* of the IC chip 80, implements a printing control, which will be described in detail later, and outputs instructions for performing maintenance operations such as the flushing and purging operations. The gate array 42 processes print data it has received from a host computer 71 via an interface (I/F) 41. To the CPU 57 and the gate array 42 are connected a ROM 43 and a RAM 44. The ROM stores computer programs for implementing the printing control as described later, as well as various data including data indicating a reference value of ink consumption, and a RAM 44 for temporarily storing the print data that the gate array 42 has received from the host computer 71.

To the CPU 57 are connected, for instance, a sheet sensor 58 for detecting the paper sheet P, an origin sensor 46 for detecting the printhead 30 positioned at its home position, a temperature sensor 59 for measuring an environmental temperature which is the temperature of the environment in which the printer 1 rests or is used, a motor driver 48 for driving the carriage motor 10, another motor driver 48 for driving a sheet feeding motor (LF motor) 50, and an operation panel 56 through which an operator inputs various instructions based on which corresponding signals are inputted to the CPU 57. An image memory 51 for temporarily storing, in the form of image data, the print data sent from the host computer 71 is connected to the gate array 42. The drive circuit 80*a* operates based on print data 52 as outputted from the gate array 42, a transfer clock CL1, and a print clock CL2, to drive the piezoelectric actuator 32. To the gate array 42, there is also connected an encoder sensor 55 for reading marks on an encoder member (not shown) disposed along the direction of reciprocation of the head holder 9.

<Description of First Experiment>

There will be described a first experiment conducted by the inventor, by referring to FIG. 6

Figure 6:
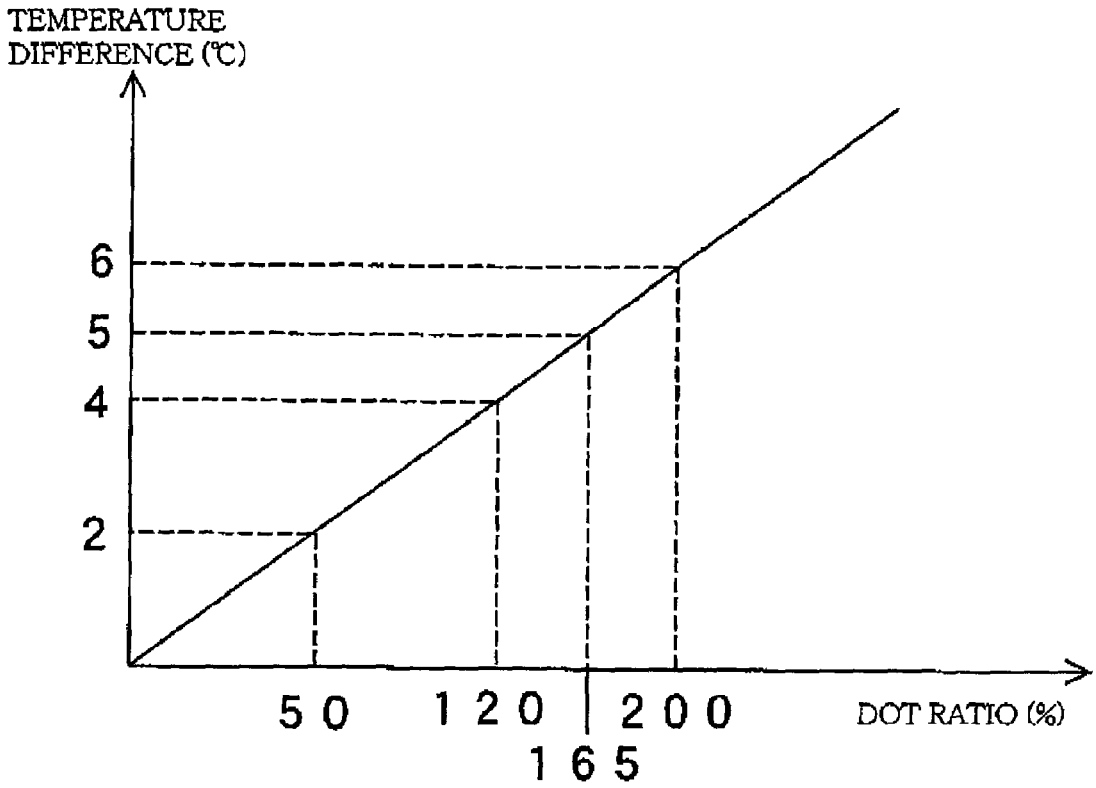
FIG. 6 is a graph showing a result of a first experiment on a relationship between the dot ratio and the temperature difference between given two places in the nozzle surface of the printhead.

FIG. 6 is a graph indicating a result of an experiment regarding a relationship between the dot ratio and the temperature difference between specific two places in the nozzle surface of the printhead. In the experiment, a place E3 and a place E4 as shown in FIG. 4 were selected as the two places. The place E3 was a portion corresponding to the nozzles located at the central portion of the nearest one 33*a* of the nozzle rows to the IC chip 80 at the side of the printhead 30. On the other hand, the place E4 was a portion corresponding to the nozzles located on the uppermost stream side with respect to the ink supply, in the farthest one 33*d* of the nozzle rows from the IC chip 80.

FIG. 6 shows the result obtained when the temperature difference was measured in a printing operation which was continuously performed at dot ratios of 50%, 120%, 200%, and at a resolution of 600×300 dpi, on paper sheets of A4 size by taking a same, unit time for printing over each single side or page of the paper sheet. In this experiment, the term "dot ratio" refers to a ratio of the number of the dots actually printed, to a maximum number of dots printable on a page of paper sheet P using a single ink (i.e., the number of dots in solid print of single color). For instance, when printing at a dot ratio of 120% is performed, dots are formed over an entire print area on the paper sheet with ink of a color, and additionally a part of the paper sheet corresponding to 20% of its entire print area is filled with dots formed with ink of another color, while the overall printing is performed by taking the unit time as described above. That is, when the dot ratio is changed, the speed of movement of the carriage or head holder 9 is not changed, but there is changed the total number of dots formed on the paper sheet irrespectively of the color of the dots. Similarly, when the dot ratio is at 200%, the single page of the paper sheet is printed solid over its entire print area, with two inks of respective colors. For instance, the entire print area of a paper sheet is printed solid in red, as well as in blue. Each dot was formed by a droplet of a color ink and in the same volume, and the result shown in FIG. 6 was obtained when a single dot was formed with ink of a volume of 15 pl. In the present experiment, printing over a single page of paper sheet was completed by taking about 30 seconds.

In the experiment, the temperature difference became 2° C., 4° C., and 6° C., when the dot ratio was 50%, 120%, and 200%, respectively. With the temperature difference at 4° C., degradation in the print quality was not seen. However, when the temperature difference had risen to 6° C., the degradation occurred. Hence, the inventor repeated the printing with the dot ratio gradually increased from 120%, to find that when the temperature difference reaches 5° C., the print quality starts to lower, with the dot ratio at 165%. There was found a tendency that the larger the volume of each ink droplet was, the smaller the value of the dot ratio was upon the temperature difference reaching 5° C.

<Conclusion>

As apparent from the above experiment, it was found that when the printing is performed with the dot ratio at 165% or above, the printhead should be cooled by interrupting the printing at a suitable timing so that the temperature difference does not exceed the limit value 5° C. In addition, since the temperature difference varies depending on the dot ratio, it is preferable that the length of the intermission is changed with the dot ratio.

<Flow of the Printing Control>

Hereinafter, by referring to flowchart of FIG. 7 there will be described a flow of a control of printing which the CPU 57 implements, as an embodiment of the invention utilizing the result of the experiment as described above.

In the description below, the term "ink consumption C" refers to an amount of ink which has been actually consumed in the last printing over an entire print area on a single page of a paper sheet of A4 size, while the term "reference value of ink consumption" refers to a value corresponding to an amount of ink which is required for the temperature difference between the places E3 and E4 on the printhead 30 to reach its reference value ΔT, namely, 5° C. The term "delay time" refers to a period of time by which the start of printing of the next paper sheet is deferred.

Figure 7:
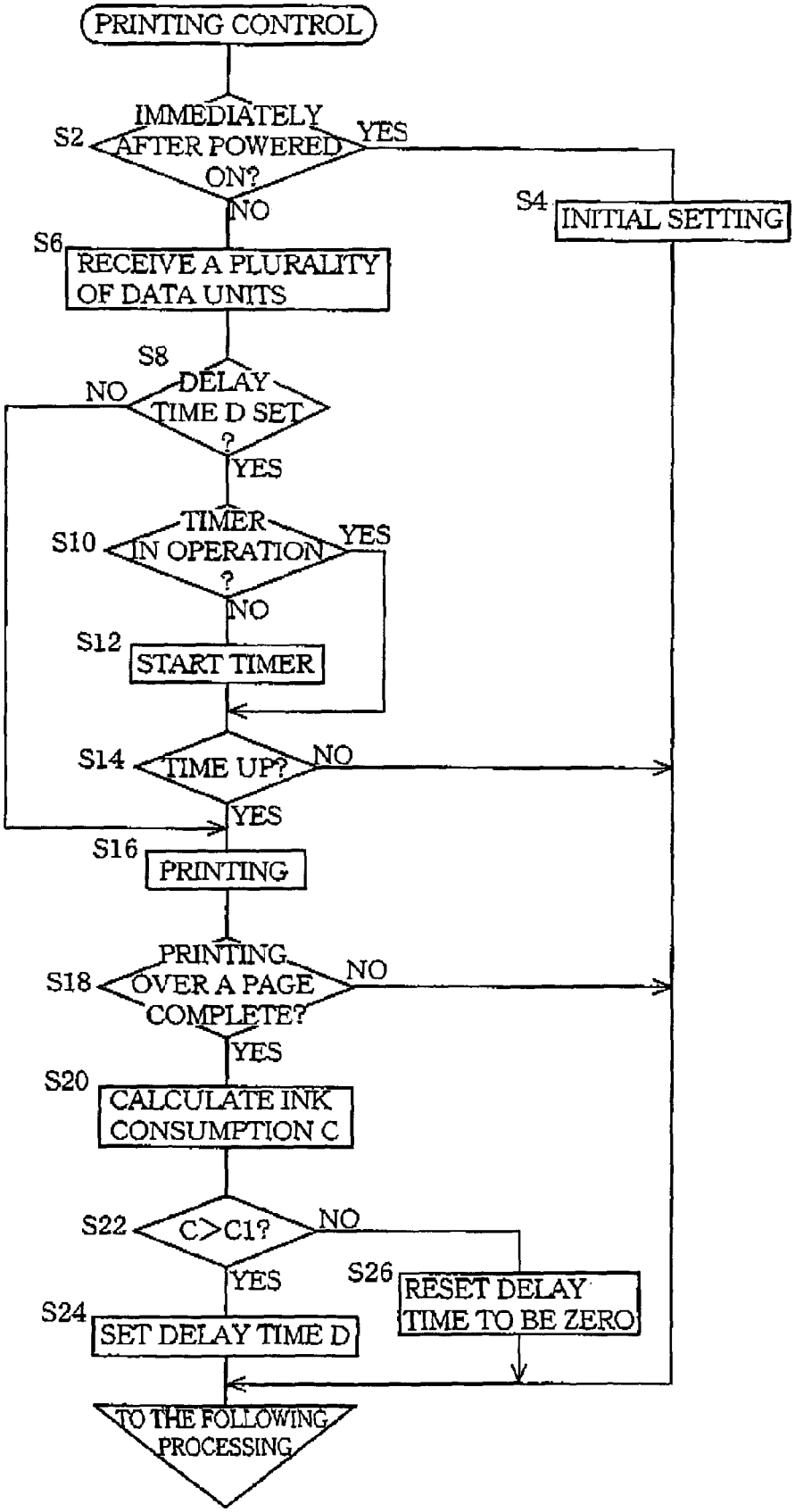
FIG. 7 is a flowchart illustrating a printing control executed by a CPU 57.

The flowchart shown in FIG. 7 starts with step S2 at which the CPU 57 determines whether it is immediately after the inkjet printer 1 is powered on. When an affirmative decision (YES) is obtained in step S2, that is, when it is determined that the printer 1 has just been powered on, the control flow goes to step S4 to implement an initial setting. On the other hand, when a negative decision (NO) is made in step S2, the flow goes to step S6 to receive a plurality of data units (raster data) constituting print data for a single page of print sheet, from the host computer 71. Each of the data units corresponds to a single raster or a plurality of rasters, and is printed by taking a given unit time. Then, the CPU 57 determines in step S8 whether the delay time is set. When a negative decision (NO) is obtained in step S8, the flow goes to step S16 to implement printing, and then to step S18 to determine whether the printing is complete. When an affirmative decision (YES) is obtained in S18, the flow proceeds to step S20 in which the ink consumption, which is represented as C, is calculated.

Figure 8:
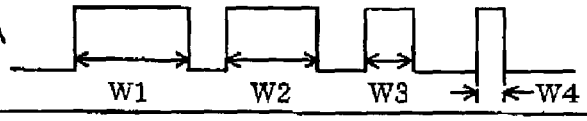
FIG. 8 shows a relationship among the kind of ink droplets, the waveform of drive signals, and the volume of ink droplets.
Figure 8:
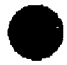
Figure 8:
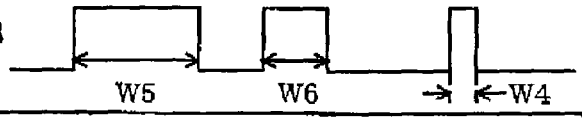
Figure 8:
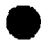
Figure 8:
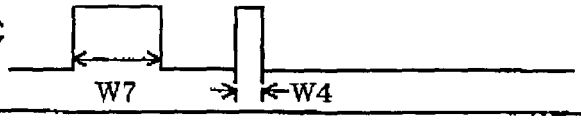
Figure 8:
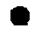

The ink consumption C is calculated by summing up the volumes of all the ink droplets which have been ejected from the nozzles onto the paper sheet. FIG. 8 shows a relationship among the kind or size of ink droplets, the waveform of drive signals, and the volume of ink droplets of the respective sizes. There are three kinds of ink droplets, namely, large droplet, medium droplet, and small droplet, whose volume are respectively 30 pl, 15 pl and 5 pl. These volumes are determined by the waveforms of the drive signals supplied to the actuator. That is, a large droplet is ejected when a drive signal of a waveform A formed of a train of pulses W1, W2, W3, W4 of respective pulse widths (i.e., time lengths of voltage application) is supplied to the actuator. A medium droplet is ejected when a drive signal of a waveform B formed of a train of pulses W5, W6, W4 of respective pulse widths is supplied, while a small droplet is ejected when a drive signal of a waveform C formed of a train of pulses W7, W4 is supplied.

The ROM 43 (shown in FIG. 5) of the inkjet printer 1 stores a table where the drive signal waveforms A, B, C are associated with the volumes 30 pl, 15 pl, 5 pl of ink droplets. Information designating the kind A-C of waveform of each drive signal is included in each of data units constituting the print data sent from the host computer 71 connected to the inkjet printer 1. The CPU 57 of the printer 1 determines the kind of the waveform of each drive signal designated for each data unit, upon processing of the received print data, and references the above-mentioned table to retrieve the volume of the ink droplet corresponding to the thus determined kind of drive signal. The retrieving the ink volume is repeated, and the retrieved volumes are accumulated so as to calculate in step S20 the cumulative value of ink which has been consumed for the printing of the single page of paper sheet.

For instance, when the drive signals of the waveforms A, B, C are applied to the actuator $10^6$ times, respectively, in the printing on the single page of the A4-size paper sheet, the following equation is established: the ink consumption $C=(30\text{ pl}+15\text{ pl}+5\text{ pl})\times10^6=50\times10^6\text{ pl}=5\times10^{-2}$ ml.

In the next in step S22, the CPU 57 determines whether the ink consumption C exceeds a reference value C1. When an affirmative decision (YES) is obtained in step S22, that is, when C>C1, the flow goes to step S24 to set a delay time D. When a negative decision (NO) is obtained in step S22, that is, when C≦C1, the flow goes to step S26 to set the value of the delay time, which is represented as D, to be zero. In the present embodiment, the reference value C1 is 0.8 ml, which corresponds to an amount of ink consumed when printing is performed under a condition that the resolution is at 600×300 dpi, the dot ratio is at 165%, and each dot is formed of an ink droplet of 15 pl. This condition is the same as that in the above-described experiment. However, the reference value C1 may be 0.5 ml for a resolution of 600×150 dpi, and 0.9 ml for the resolution of 600×600 dpi.

On the other hand, when an affirmative decision (YES) is made in step S8, that is, when it is determined that the currently set value of the delay time D is not zero, the flow goes to step S10 in which the CPU 57 determines whether a timer for counting the delay time is in operation. When a negative decision (NO) is made in step S10, that is, when it is determined that the timer is not in operation, the flow goes to step S12 to start the timer. Subsequently, the flow goes to step S14 to determine whether the delay time has lapsed, and when a negative decision is made in step S14, that is, when it is determined that the delay time has not lapsed, the flow proceeds to the next processing, that is, the following processing and the steps S2-14 are reiterated until it is determined in step S14 that the delay time has lapsed.

When an affirmative decision (YES) is obtained in step S14, that is, when it is determined that the delay time has lapsed, the flow goes to S16 to start printing on the next paper sheet, and steps S18 through S26 are implemented as described above. That is, each time the delay time of the value set in step S24 lapses, printing based on a plurality of data units (raster data) for the next page of paper sheet is performed.

Effects of the First Embodiment

In the arrangement of the above-described embodiment, the IC chip 80 generating heat and the heatsink 60 for releasing this heat are disposed at the side of the nozzle row 33*a*. Therefore, a difference in temperature occurs between the nozzle row 33*a* near the IC chip 80 and the nozzle row 33*d* the farthest from the IC chip 80. In addition, since the heat is transferred by flow of the ink, the temperature difference becomes the largest between the places E3 and E4 as shown in FIG. 4. In the arrangement of the conventional printer, this may cause degradation in the print quality. However, in the inkjet printer 1 of this embodiment where the start of printing on the next page of paper sheet is deferred when the ink consumption exceeds the reference value, the print head 30 is allowed to cool by itself.

Thus, there can be obtained an inkjet printer where the print quality is not affected by the temperature difference between the central portion of the nozzle row which is the nearest one of the nozzle rows in the print head 30 to the IC chip 80, and the portion at the uppermost stream side, with respect to the ink flow, of the farthest one of the nozzle rows from the IC chip 80. Since the deferring of the start of the next printing is implemented by page, intermission is inhibited throughout the printing over each page of paper sheet.

According to the present embodiment, when the ink consumption does not exceed the reference value, the start of printing on the next page is not deferred. Thus, when the present printer performs printing of a document or the like consisting of a plurality of pages on some of which printing is to be performed with the ink consumption not exceeding the reference value while on the others of which printing is to be performed with the ink consumption exceeding the reference value, the start of printing on the next page is selectively deferred, that is, the printing on the next page is not deferred where appropriate. In this way, where plural pages are sequentially printed, the required overall time is reduced.

Second Embodiment

Figure 9:
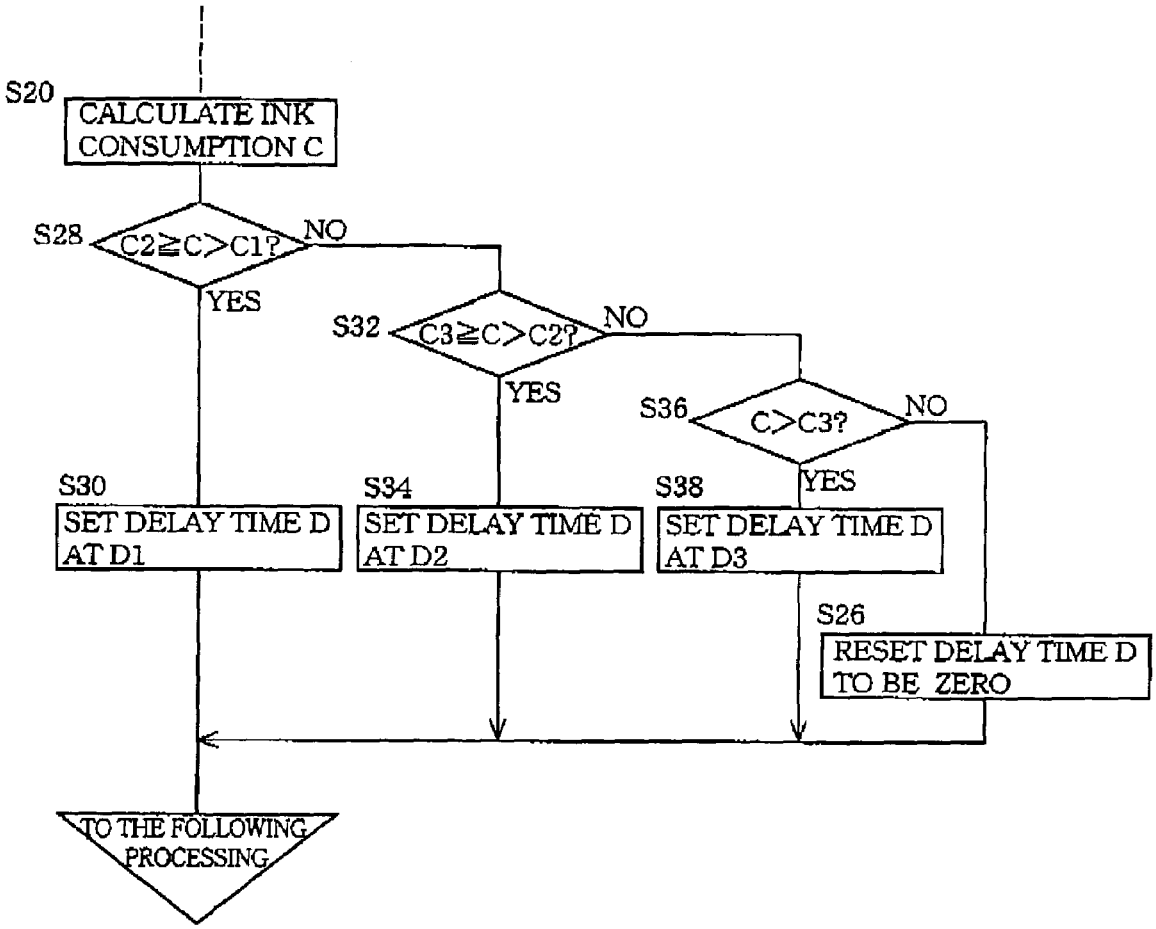
FIG. 9 is a flowchart illustrating a part of a printing control executed by a CPU in an inkjet printer according to a second embodiment of the invention.

There will be described a second embodiment of the invention, by referring to FIG. 9 presenting a flowchart illustrating a part of a printing control executed by a CPU included in an inkjet printer according to the second embodiment.

The inkjet printer of the second embodiment is characterized in that the delay time set when the ink consumption exceeds the reference value is varied according to how much the ink consumption exceeds the reference value. The present inkjet printer is identical in structure and function with those of the first embodiment except a part of the printing control, and only the different part will be described below with the identical elements or parts denoted by the same reference numerals and symbols as used in the first embodiment. In the description below, the size of the values C1, C2, C3 of the ink consumption reference value increases in this order, that is, C1 is the smallest while C3 is the largest. The size of the values D1, D2, D3 of the delay time D increases in this order, that is, D1 is the shortest while D3 is the longest. The values C1, C2, C3 of the ink consumption reference value and values D1, D2, D3 of the delay time D are predetermined based on the result of the experiment that the temperature difference on the printhead and the time required for completing printing on a single page of paper sheet (hereinafter referred to as "a unit printing time") are both directly proportional to the ink consumption. Therefore, C1=0.8 ml, C2=0.96 ml, and C3=1.12 ml. The unit printing time where the ink consumption C is below the reference value C1 is set at 30 seconds, while D1 and D2 are respectively 6 and 12 seconds. When D3 is selected, deferring of the same value as D2, namely, deferring of 12 seconds, is applied, as well as a single purging operation is performed before the printing on the next page is started, so that D3 is in effect larger than D2.

There will be now described briefly another experiment and discussion on a result of the experiment.

It was found that the temperature difference on the printhead 30 increases as the printing continues and comes to correspond to the current value of the ink consumption, so that the temperature difference is directly proportional to the ink consumption. With the resolution at 600×300 dpi, the temperature difference became 5° C. when the ink consumption reached 0.8 ml, as described above. Therefore, in the present embodiment, as an initial reference value of the temperature difference for reviewing or changing the delay time, 5° C. at which the print characteristics starts deteriorating is employed, and the delay time is reviewed or changed every time the temperature difference increases by 1° C. Thus, C1 (=0.8 ml), C2 (=0.96 ml), and C3 (=1.12 ml) respectively correspond to temperature differences of 5° C., 6° C., and 7° C.

The temperature difference is attributed to power consumed for driving the actuator. The power required for ejecting an ink droplet of a unit amount C0 in a unit printing time t can be expressed by $(cV/t)\cdot V$, where c represents an electrostatic capacity of the actuator, while V represents the voltage at which the actuator is driven. Accordingly, when the ink consumption is C, the corresponding power consumption w is expressed by $(cV/t)\cdot V\cdot C/CO$. When a value of the ink consumption C which gives a temperature difference of 5° C. (i.e., a reference value) is expressed by C1, the unit printing time t in this case is t5 and the power consumption w is w5. In this case, $w5=(cV/t5)\cdot V\cdot C1/C0$.

On the other hand, when w=w5 while the ink consumption C and the unit printing time t having any values, there is obtained the following equation: $t=(C/C1)\cdot t5$. This equation expresses that even in a case where the ink consumption C takes a value which makes the temperature difference equal to or larger than 5° C. while the unit printing time t is t5, the temperature difference can be held down at 5° C. when the unit printing time t is changed from t5 to a value which satisfies the above equation. The delay time added to the unit printing time t5 is expressed by $(C/C1-1)\cdot t5$. In the present embodiment, where the ink consumption C is larger than C1 but not larger than C2 (i.e., $C1<C\leqq C2$), the delay time D is set at a value D1 corresponding to the ink consumption reference value C2, namely, 6 seconds. Similarly, where the ink consumption C is larger than C2 but not larger than C3 (i.e., $C2<C\leqq C3$), the delay time D is set at a value D2 corresponding to the ink consumption reference value C3, namely, 12 seconds. The reference values C1, C2, C3 of the ink consumption C and the values D1, D2, D3 of the delay time D in this embodiment are determined based on the result described above.

Hereinafter there will be described in detail an operation according to the second embodiment, by referring to the flowchart of the FIG. 9.

After implementation of steps S2 through S18 shown in FIG. 7, the flows goes to step S18 in which CPU 57 determines whether printing on a single page of paper sheet is complete. When an affirmative decision is obtained in step S18, the CPU 57 calculates the ink consumption C in step S20. Then, the flow goes to in step S28 to determine whether the ink consumption C is larger than the reference value C1 and not larger than the reference value C2. When an affirmative decision is obtained in step S28, the flow goes to step S30 to set the delay time D at D1. On the other hand, when a negative decision (NO) is obtained in step S28, the flow goes to step S32 to determine whether the ink consumption C is larger than the reference value C2 but not larger than the reference value C3. When an affirmative decision (YES) is obtained in step S32, the flow goes to step S34 to set the delay time D at D2. When a negative decision is obtained in step S32, the flow goes to step S36 to determine whether the ink consumption C is larger than the reference value C3. When an affirmative decision (YES) is obtained in step S36, the flow goes to step S38 to set the delay time D at D3. When a negative decision (NO) is obtained in step S36, that is, when it is determined that the ink consumption is not larger than C3, the flow goes to step S26 to set the delay time D at zero.

As described above, in the inkjet printer according to the second embodiment, the delay time is increased when the ink consumption exceeds the reference value, such that the delay time increases with an amount by which the ink consumption exceeds the reference value.

An arrangement where a constant delay time corresponding to a maximum ink consumption is always set regardless of how much the ink consumption actually exceeds the reference value may suffer from a drawback that when the ink consumption is relatively small, the delay time is unnecessarily long, that is, the start of the next printing is deferred by a period of time too long than required. According to the present embodiment of the invention, however, such a drawback is prevented. Further, it does not occur in the present embodiment that the delay time is too short for the difference between the actual ink consumption and the ink consumption reference value when these values greatly differs, which would otherwise lead to failure to satisfactorily prevent the adverse effect of the heat generated in the last printing on the next printing. In other words, the next printing is deferred by a period of time necessary and sufficient with respect to the heat generated in the last printing, thereby enhancing the efficiency of printing.

Third Embodiment

In the printing control according to the first and second embodiments, the ink consumption is calculated for each page, and when the ink consumption exceeds the reference value, the delay time is set for the next printing of a page. According to a third embodiment of the invention, however, the delay time is set for each raster or each plurality of rasters.

Figure 10:
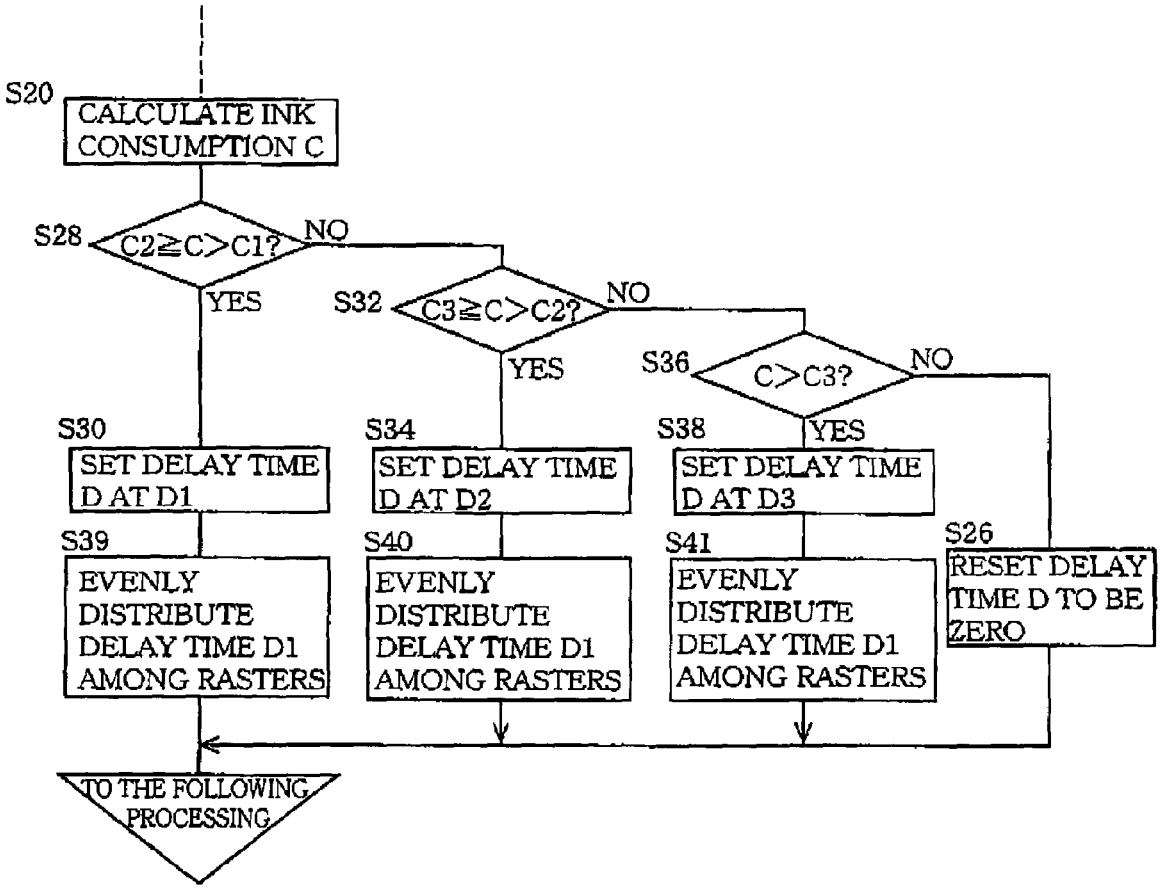
FIG. 10 is a flowchart illustrating a part of a printing control executed by a CPU in an inkjet printer according to a third embodiment of the invention.

The third embodiment will be described in detail by referring to FIG. 10, which shows a part of a flowchart illustrating a printing control executed by a CPU of an inkjet printer according to the embodiment. That is, except a part of the printing control, the inkjet printer of the third embodiment is identical in structure and functions with those of the above-described embodiments, particularly with those of the second embodiment. The identical parts are not described here, but denoted by the same reference numerals as used in the above embodiments.

In the control flow, the CPU 57 implements steps S2-S18 to complete printing on a single page of paper sheet, and then calculates the ink consumption C in step S20. The ink consumption C is compared with the reference values C1, C2, C3, to select the corresponding value of the delay time D from among 0, D1, D2, D3 and set the selected value. Until this step, the control flow is identical with that of the second embodiment. However, to the control flow of the third embodiment are further added steps S39, S40, S41 in which the set delay time is evenly distributed among a plurality of data units (raster data) constituting print data for a single page of paper sheet, as shown in FIG. 10. That is, the amount of ink as has been actually consumed in the printing over a last single page of paper sheet is compared with the reference values, thereby determining a necessary delay time, which is divided into a plurality of sub delay times having a same length so as to be distributed to respective raster data or data units which together constitute the print data for the printing on the next single page. In the present embodiment, the raster data or data unit correspond to a single raster. According to this arrangement, even when there may be caused degradation in the print quality when printing on a single page is complete, due to a relatively large temperature difference occurring due to heat generated during the printing is performed, the printing operation is continuously and smoothly performed, without intermission which would be otherwise required for cooling the printhead, until the printing over the single page is complete. When the next page is printed, too, a delay time is divided into a plurality of sub delay times of a same time length, and evenly distributed to the data units constituting print data for this page, thereby enabling to smoothly perform the printing operation without long intermission.

In the third embodiment, it may be adapted such that each of the data units correspond to a plurality of rasters, not a single raster, and the set delay time is distributed among such data units.

<Description of Second Experiment>

There will be provided description of a second experiment conducted by the inventor, by referring to FIGS. 11-17.

In this experiment, too, there are formed three kinds of ink droplets, namely, large, medium and small droplets, as shown in FIG. 8, which respectively correspond to waveforms A, B and C of drive signals.

The inventor measured a difference in temperature between two places E3 and E4 in the nozzle surface 31*a* (shown in FIG. 4) after printing has been continuously performed, on a paper sheet P of A4 size and at a resolution of 600×600 dpi for instance, by ejecting the above-mentioned three kinds of ink droplets from rows 33*a*-33*d* of nozzles for respective color inks (namely, 33*a* for yellow, 33*b* for magenta, 33*c* for cyan, 33*d* for black) with the environmental temperature at 25° C., and investigated a relationship between the temperature difference and the print quality. The continuous printing was performed for a plurality of values of dot ratio, namely, 50%, 120%, 165% and 200%.

The ink consumption was obtained by cumulatively increasing the number of times ink droplets are ejected with taking into consideration the difference in waveform of the drive signals, each for forming a dot on the paper sheet P, in other words, taking into consideration the volumes of the respective ink droplets. This counting of the number of ink droplet ejections for obtaining a total volume of ink consumed was performed by means of an ink consumption counter capable of counting the dots. The ink consumption counter did not simply count the number of dots, but counted dots such that an ejection of a small droplet increased the count by one, an ejection of a medium droplet increased the count by three, and an ejection of a large droplet increased the count by six. The size of the ink droplets was obtained by determining which one of the waveforms A, B, C each drive signal included in the print data sent from the host computer had.

<Conclusion>

As a result, it was found that when the count of the ink consumption counter (hereinafter simply referred to as "an ink consumption count") exceeded 30 million during printing is continuously performed with the dot ratio at 165%, the above-mentioned temperature difference between places E3 and E4 reached 5° C. As to the print quality, after the temperature difference between the places E3 and E4 had reached 5° C., defects such as a lighter and/or darker band(s), i.e., so-called banding, and a white line occurred at a part of the paper sheet corresponding to the part between the places E3 and E4. Such defects were not found before the temperature difference reached 5° C.

Thus, it was found that the banding and white line do not occur and the print quality can be enhanced when printing with the dot ratio at 165% is performed such that when the ink consumption count exceeds 30 million during printing on a page of paper sheet, start of printing on the next page is deferred to accelerate the cooling of the printhead 30 in order to hold the temperature difference at or under 5° C. It is noted that the term "dot ratio" refers to a ratio of the number of the dots actually printed, to a maximum number of dots printable on a page of paper sheet P at a resolution, by taking a predetermined unit time (i.e., the number of dots in solid print of single color).

Meanwhile, there is known a technique to increase the voltage of drive signals as the environmental temperature decreases, so as to maintain the print quality at satisfactory level by keeping the ink ejection characteristics constant, since the viscosity of ink increases with decrease in the environmental temperature. However, it was found that the raising the voltage of the drive signals requires increased power to the actuator, accelerating the temperature rise at the IC chip 80. Further, the temperature difference increases with an increase in the ink consumption such that the rate of increase gradually decreases as the temperature of the printhead 30 rises, in other words, the increase in the temperature difference is nonlinear. More specifically, for a same increment in the ink consumption, the rate of increase in the temperature difference is different in an initial phase of a printing operation where the cumulative amount of the ink consumption is relatively low, from that in a later phase of the printing operation where the cumulative value of the ink consumption has been already increased to some degree.

With the above findings, it was apparent that for the same ink consumption, the time taken until the temperature difference reaches 5° C. and the way in which the temperature difference reaches 5° C. differ depending upon the environmental temperature and the cumulative amount of ink ever consumed. This means that the temperature difference reaching 5° C. can not be accurately detected unless a suitable value is added to or subtracted from the ink consumption count, by taking the above-described factors into consideration.

Figure 12:
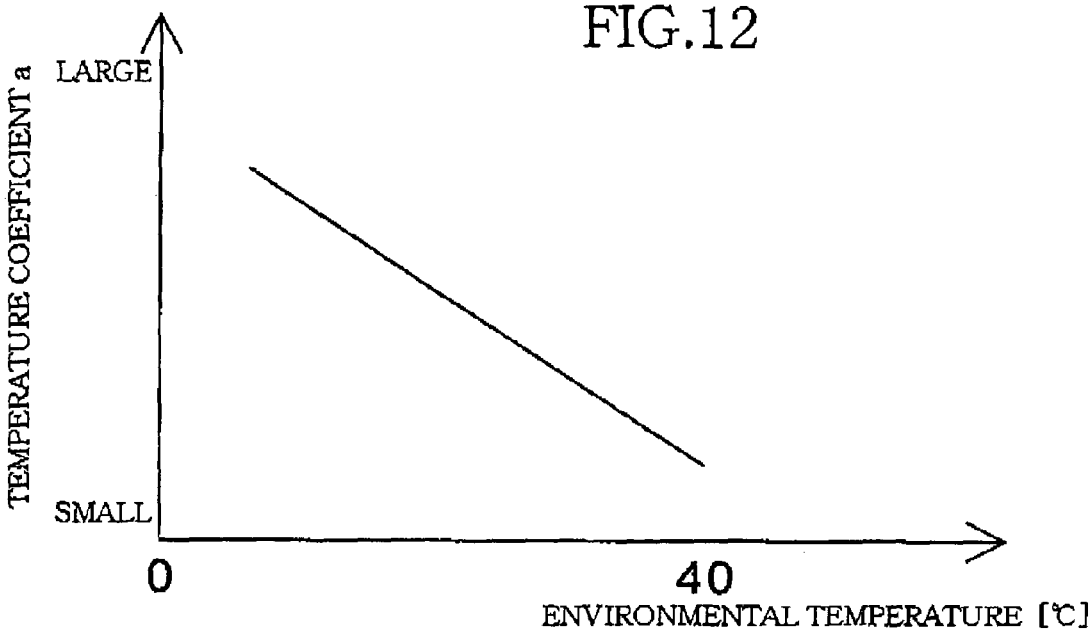

Thus, the inventor developed a method of correcting the ink consumption count depending upon the degree of the effects of the above-described factors on the temperature difference. First, the inventor investigated how much the ink consumption count should be corrected with respect to the environmental temperature, and found there is a relationship that as the environmental temperature increases, a coefficient a of temperature (hereinafter referred to as "a temperature coefficient a"), which represents the degree of the effect of the environmental temperature on the temperature difference, decreases, as shown in FIG. 12. That is, it was found that the effect of the environmental temperature on the temperature difference can be compensated for by multiplying the ink consumption count by the temperature coefficient a corresponding to the current value of the environmental temperature.

Then, it was investigated how much the ink consumption count should be corrected according to the cumulative amount of the ink consumption so far. The counter for counting or calculating the ink consumption by taking into consideration the above-mentioned effects is referred to as "a thermal control counter", while the count or the value updated by the thermal control counter, in other words, the ink consumption calculated taking into consideration the above-mentioned effects is referred to as "a thermal control count k".

Figure 13:
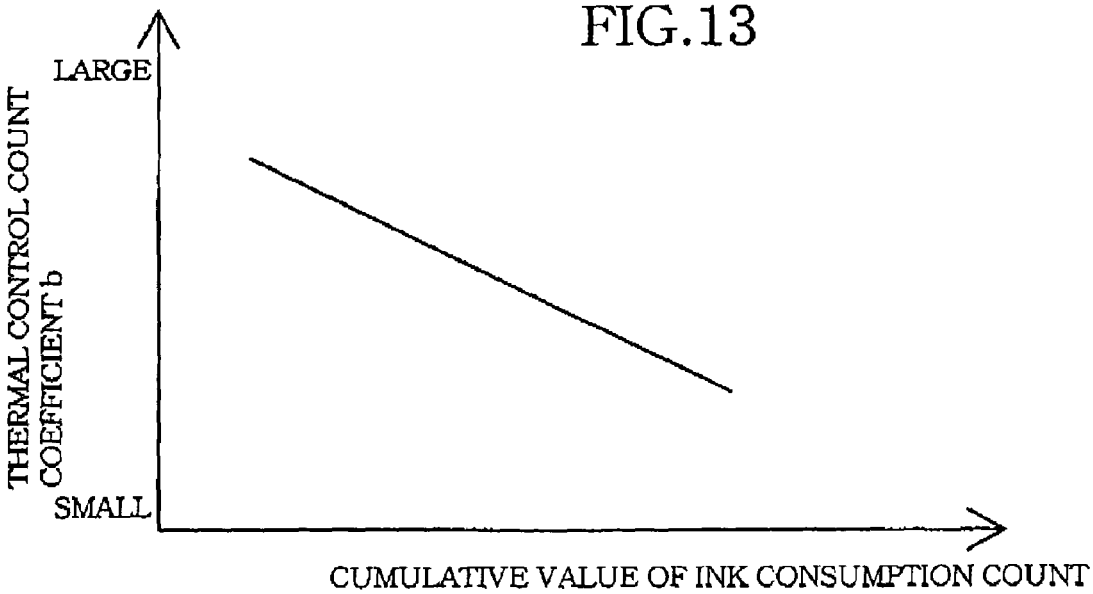
FIG. 13 shows a relationship between the cumulative value of an ink consumption count and a thermal control count coefficient b.

As a result, there was obtained a relationship as shown in FIG. 13 between the cumulative value of the ink consumption count and the degree of the effect related to the cumulative value of the ink consumption on the temperature difference, which degree is represented by a coefficient b of thermal control counter (hereinafter referred to as "a thermal control count coefficient b"). Based on this relationship, it was found that the thermal control count coefficient b decreases with an increase in the cumulative value of the ink consumption count. That is, by multiplying the cumulative value of the ink consumption count by the thermal control count coefficient b, the effect related to the ink consumption on the temperature difference can be compensated for.

More specifically, where k represents the thermal control count, C represents the ink consumption count indicative of the amount of ink consumed for the current printing on a single page of paper sheet, a represents the temperature coefficient, and b represents the thermal control count coefficient, the thermal control count $k=(k_0+C\cdot a\cdot b)$. The temperature coefficient a varies depending on the environmental temperature, while the thermal control count coefficient b varies depending on the thermal control count k. It is noted that $k_0$ represents the previous value of the thermal control count k.

Figure 11:
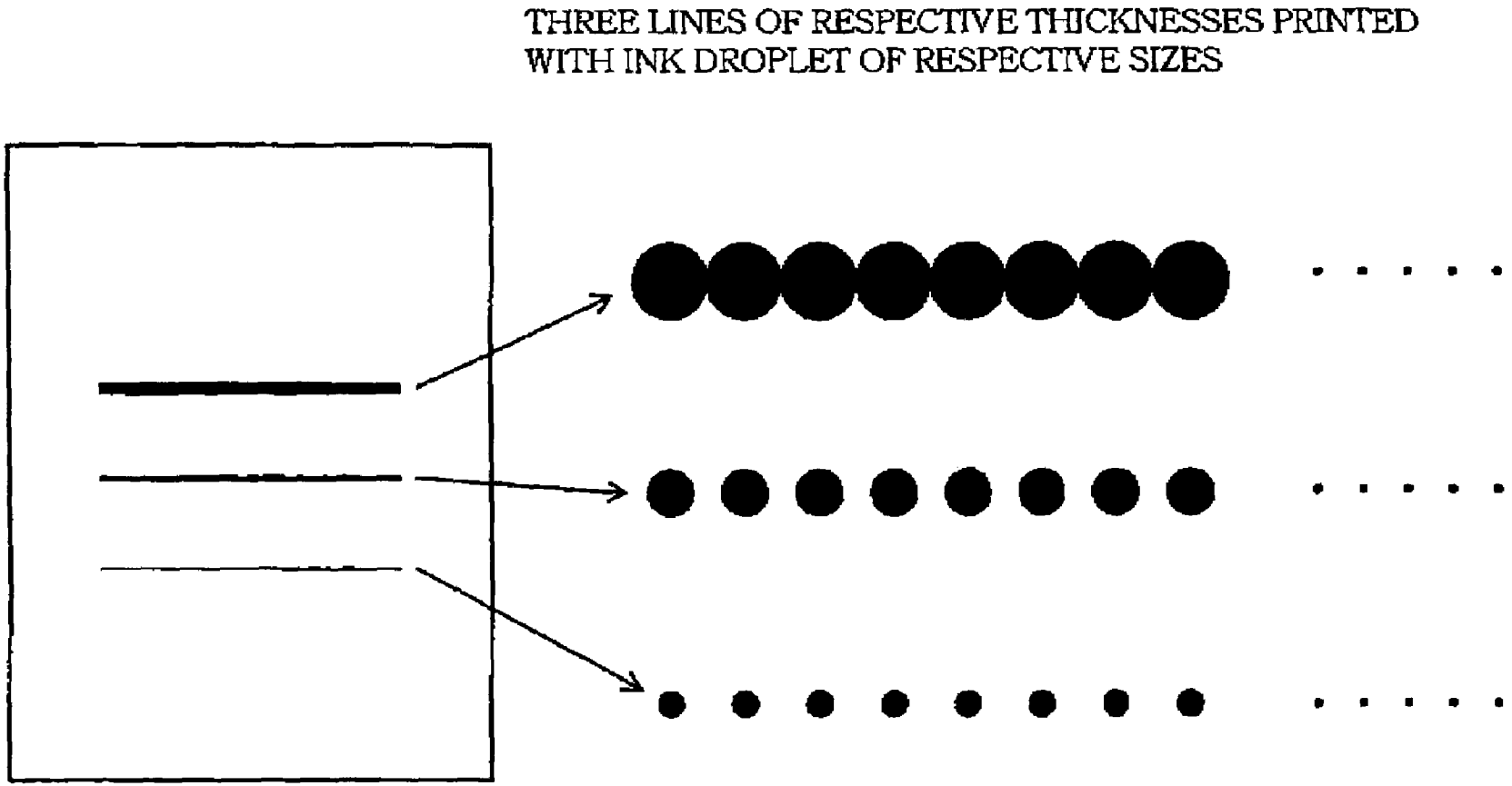
FIG. 11 illustrates lines printed by ejecting three kinds of ink droplets, respectively.

As shown in FIG. 14, when each of a large ink droplet, a medium ink droplet, and a small ink droplet are ejected, for instance, the ink consumption count C increases by 6, 3, and 1, respectively, while the thermal control count k increases by 6×a×b, 3×a×b, and 1×a×b, respectively. Let us assume a case where 50 dots are formed by ink droplets of each of the three sizes ejected while the printhead 30 is moved in the main scanning direction, three lines of respective thicknesses are printed, as shown in FIG. 11. An increment in the thermal control count k for each line were obtained with the temperature coefficient a and the thermal control count coefficient b set at 0.3 and 0.2, respectively, as shown in FIG. 15, based on the values of the environmental temperature and the cumulative ink consumption involved in the present experiment.

In this case, the increments in the ink consumption count C for ink droplets of the respective sizes are 6×50=300, 3×50=150, and 1×50=50, totaling 500. Meanwhile, the increments in the thermal control count k for ink droplets of the respective sizes are 6×50×0.3×0.2=18, 3×50×0.3×0.2=9, and 1×50×0.3×0.2=3, totaling 30.

Figure 16:
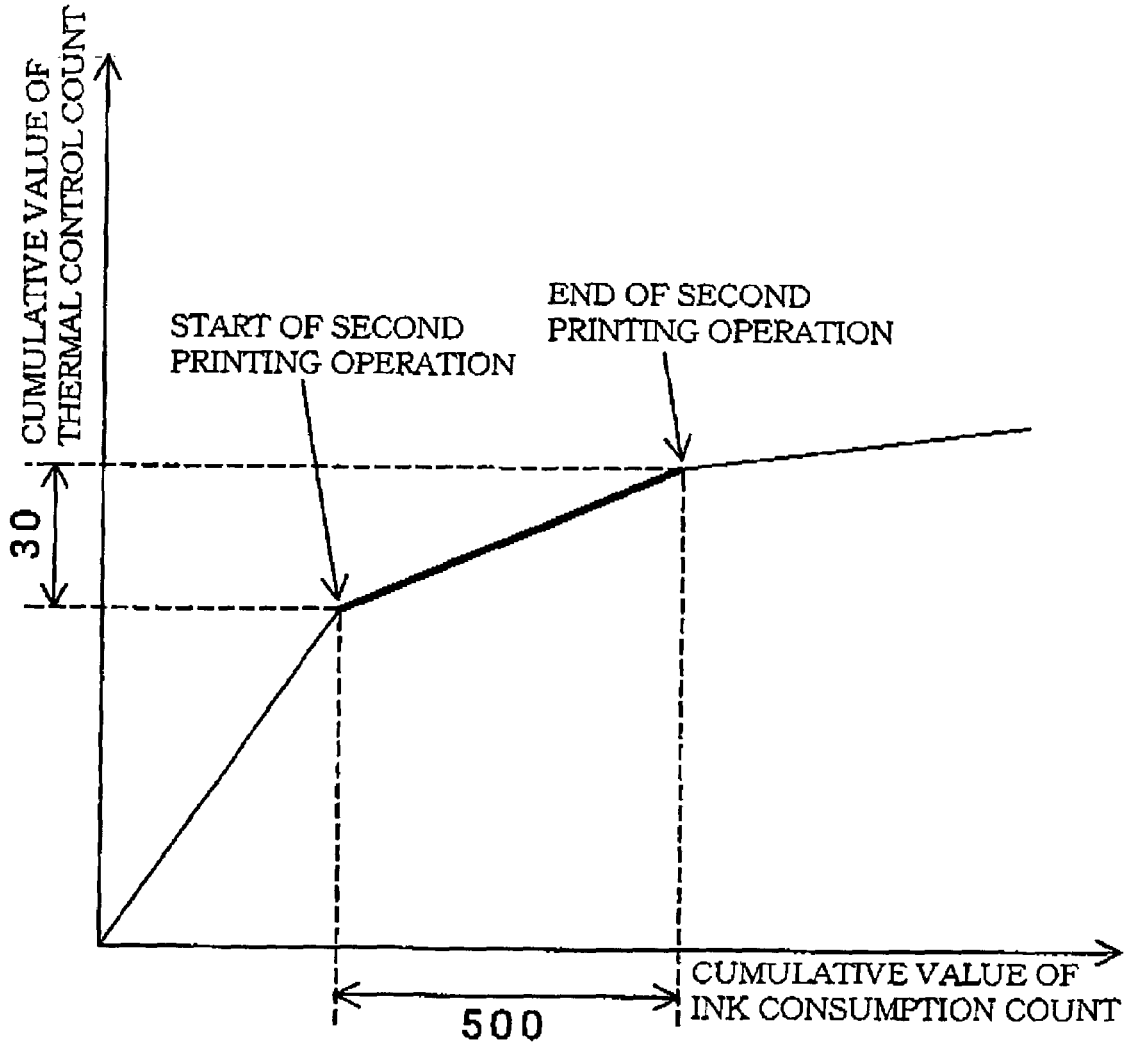
FIG. 16 shows a relationship between the cumulative value of the increment in the ink consumption count and the cumulative value of the increment in the thermal control count.

Thus, the current value 30 of the increment in the thermal control count k corresponds to the current value 500 of the increment in the ink consumption count C, and a value obtained by adding 30 to the previous value $k_0$ of the thermal control count k is the current count of the thermal control counter, as calculated for the present printing. FIG. 16 graphs this relationship in the present specific example. That is, FIG. 16 represents how the count of the thermal control counter changes when printing is repeated plural times, while the Ink droplets of different sizes are combined in a manner. In a first printing operation, an amount of ink was consumed. Subsequently, a second printing operation under the condition as described above was performed, and then a third printing operation under a condition different from that of the second printing operation was performed. It can be seen in FIG. 16 that in the first printing operation, the thermal control count k relatively rapidly increases, although the ink consumption, or, the increment in the ink consumption count C, is smaller than that in the subsequent printing operations under different conditions. This is because of the relationship of the thermal control count k with the environmental temperature and the ink consumption. In the first printing operation, a relatively large value is employed for both of the temperature coefficient a and the thermal control count coefficient b. In the second printing operation, the rate of increase in the thermal control count k is relatively low for the increment in the ink consumption count C or the ink consumption, due to the relationship with the environmental temperature and the cumulative ink consumption. The values of the temperature coefficient a and thermal control count coefficient b in the second printing operation are smaller than those in the first printing operation, namely, 0.3 and 0.2, respectively, as shown in FIG. 15. In the present experiment, further smaller values of the temperature coefficient a and thermal control count coefficient b are employed in the third printing operation.

In this way, the environmental temperature and the temperature of the printhead 30 rises as printing operations are repeated, while the rate of increase in the cumulative value of the thermal control count k, which corresponds to the temperature difference generated on the printhead 30, lowers. In other words, the cumulative value of the thermal control count k increases nonlinearly.

In a printing control performed based on this founding, when the cumulative value of the thermal control count k exceeds a reference value kc (which may be a value of the thermal control count k when the number of printed dots reaches 30 million in continuous printing where the resolution is at 600×600 dpi and the dot ratio is at 165%, for instance), start of the next printing is deferred by a predetermined delay time, to allow the printhead 30 to cool until the temperature difference decreases down to below 5° C.

In the present experiment, the increment in the thermal control count k is kept calculated as the printing proceeds, as shown in FIG. 16. In the actual operation of the inkjet printer 1, however, the increment in the thermal control count k is calculated once in a time period during which a paper sheet is fed in.

Fourth Embodiment

There will be described, by referring to FIGS. 17-20, an inkjet printer according to a fourth embodiment of the invention which is based on the results of the above-described second experiment.

<General Structure of Control System>

Figure 17:
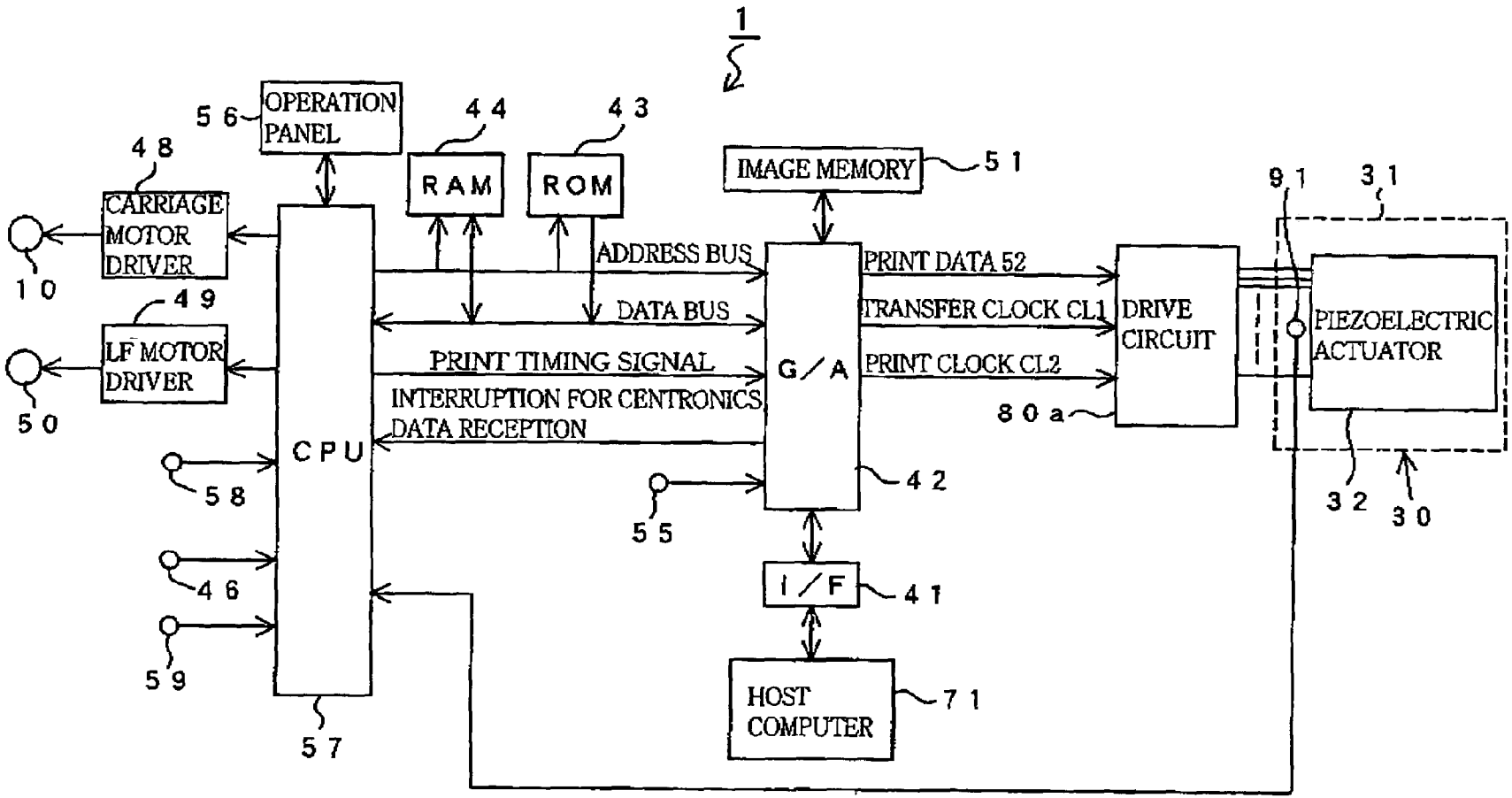
FIG. 17 is a block diagram showing a general structure of a control system of an inkjet printer according to a fourth embodiment of the invention.

A general structure of a control system of the inkjet printer according to the fourth embodiment is shown in FIG. 17. The control system is identical with that shown in FIG. 5, but further includes temperature sensors 59, 91, 91. The identical part is not described here, and the same parts or elements will be denoted by the same reference numerals as used in FIG. 5. One 59 of the temperature sensors is for measuring the environmental temperature. The other temperature sensors 91, 91 are for measuring the temperature at two places on an inkjet printhead. 30 including a cavity unit 31 whose surface constitutes a nozzle surface 31*a* of the printhead 30. Namely, one of the temperature sensors 91, 91 measures the temperature at a place E3 (as shown FIG. 4) in a surface of the printhead 30 opposite to the nozzle surface 31*a*, while the other 91 measures the temperature at a place E4 (as shown FIG. 4) in the same surface of the printhead 30 as the place E3. All of the temperature sensors 59, 91, 91 are connected to a CPU 57.

<Flow of the Printing Control>

Hereinafter, by referring to flowcharts of FIGS. 18 to 20, there will be described a flow of a control of printing which the CPU 57 implements.

In the description below, the term "ink consumption count" refers to a count which the ink consumption counter indicates when printing over a single page of paper sheet of A4 size is complete, while the term "reference value" refers to a value of the ink consumption count which the ink consumption counter indicates when the temperature difference between the places E3 and E4 on the printhead 30 reaches 5° C. The term "delay time" refers to a period of time by which start of printing on the next page of paper sheet is deferred Further, steps identical with those in the above-described embodiments are denoted by the same step Nos., and description thereof is dispensed with.

Figure 18:
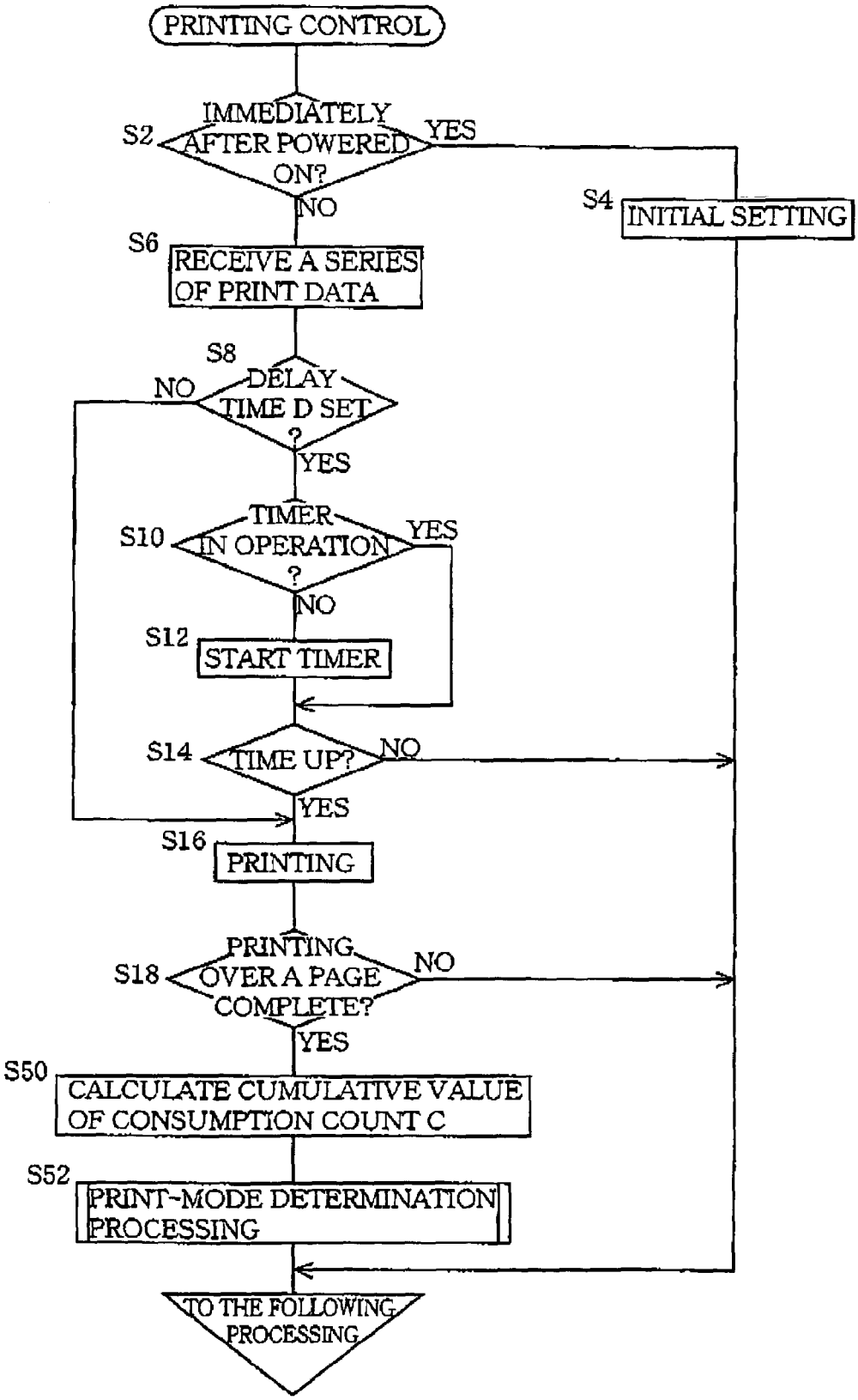
FIG. 18 is a flowchart illustrating a flow of printing control executed by a CPU in the printer according to the fourth embodiment.

The flowchart shown in FIG. 18 starts with step S2, and proceeds to step S18 in a similar same way to the flowchart shown in FIG. 7, except that the contents of the initial setting implemented in step S4 differ from that of FIG. 7. That is, in step S4 in the present embodiment, the values of the ink consumption count, the thermal control count, and the delay time D are reset to be zero, for instance. The other part of steps S2-S18 are identical with those of FIG. 7 and description thereof is not provided here.

When an affirmative decision (YES) is obtained in S18, the flow proceeds to step S20 in which the ink consumption count C is calculated based on the count of the ink consumption counter.

The ROM 43 of the inkjet printer 1 as shown in FIG. 17 stores a table where waveforms A, B, C of the drive signal are associated with the values of the increment in the ink consumption count C. Information designating the kind A-C of waveform of each drive signal is included in each of data units constituting print data for printing on a single page of print sheet, as sent from the host computer 71 connected to the inkjet printer 1. The ink consumption counter implemented as one of functions of the CPU 57 of the inkjet printer 1 determines the kind of the waveform of each dive signal designated in each data unit, upon processing of the print data received, and references the table to retrieve a corresponding value of the increment in the ink consumption count C. The retrieving the increment in the ink consumption count C is repeated, and the retrieved values are accumulated so as to obtain in step S50 the cumulative value of the increment which represents the total amount of ink which has been consumed for the printing on the single page of paper sheet.

Figure 19:
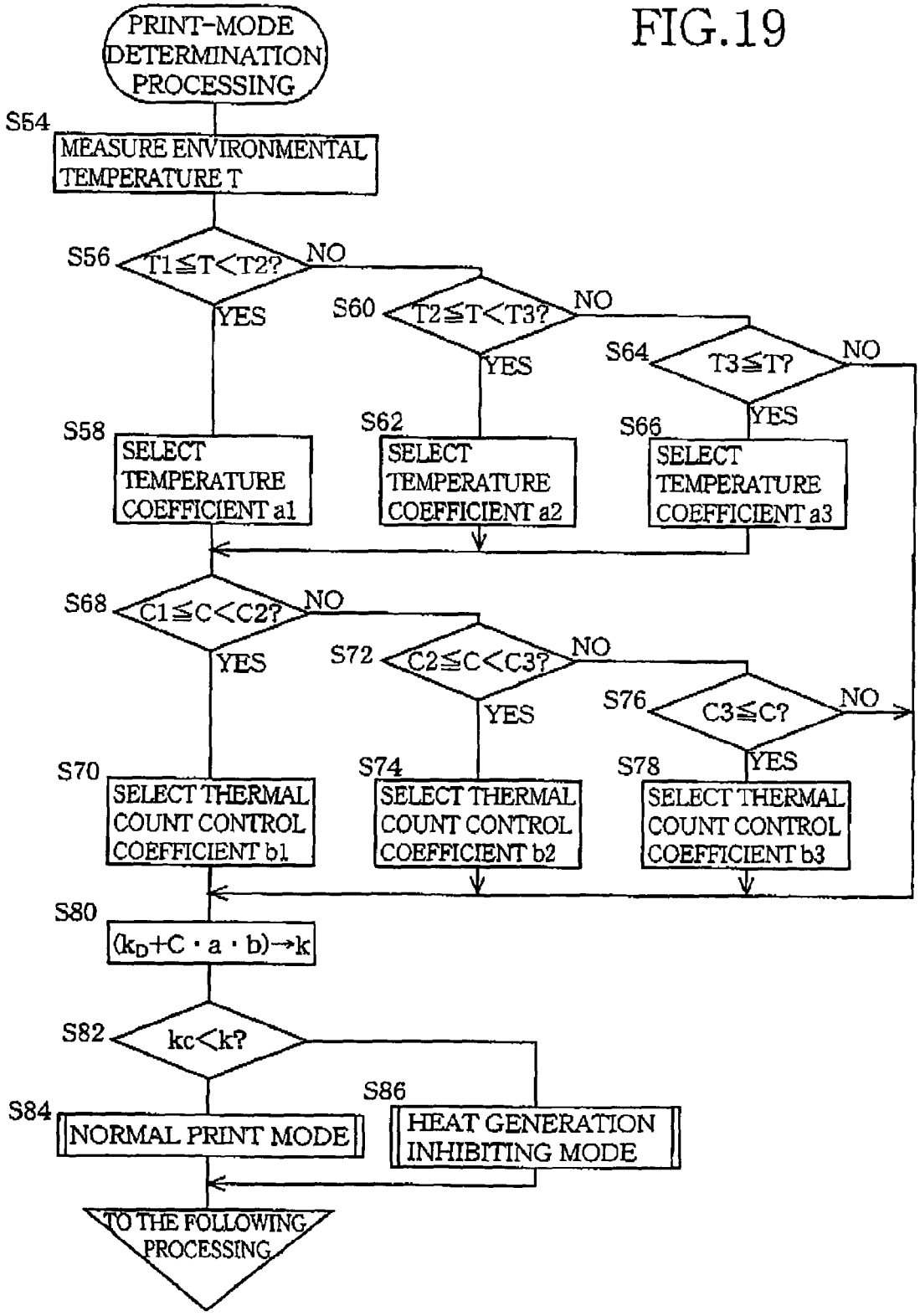
FIG. 19 is a flowchart illustrating a print-mode determination processing implemented by the CPU in the printing control shown in FIG. 18.

The flow then goes to S52 to implement "print-mode determination processing" as illustrated in FIG. 19. The print-mode determination processing begins with step S54 in which the CPU 67 measures the environmental temperature which is represented as T. The flow then goes to step S56 to determine whether the environmental temperature T is not lower than a first threshold T1 and lower than a second threshold T2. When an affirmative decision (YES) is obtained in step S56, the flow proceeds to step S58 in which a value a1 is selected from a plurality of values of the temperature coefficient a. More specifically, the ROM 43 stores a first temperature-coefficient table where a plurality of ranges of environmental temperature are associated with values a1-a3 of the temperature coefficient a, and the CPU 57 operates to select one of the values a1-a3 which corresponds to the current environmental temperature, On the other hand, when a negative decision (NO) is obtained in step S56, the flow goes to step S60 to determine whether the environmental temperature T is not lower than the second threshold T2 and lower than a third threshold T3. When an affirmative decision (YES) is obtained in step S60, the flow goes to step S62 in which the value a2 is selected from the first temperature-coefficient table.

On the other hand, when a negative decision (NO) is obtained in step S60, the flow goes to step S64 to determine whether the environmental temperature T not lower than T3. When an affirmative decision (YES) is obtained in step S64, the flow proceeds to step S66 in which the value a3 is selected from the first temperature-coefficient table.

Once having selected a value of the temperature coefficient a, the CPU 57 determines in step S68 whether the cumulative value of the ink consumption count C is not lower than a first threshold C1 and lower than a second threshold C2. When an affirmative decision (YES) is obtained in step S68, the flow goes to step S70 in which a value b1 of the thermal control count coefficient b is selected from a plurality of values of the thermal control count coefficient b. That is, the ROM 43 stores a thermal-control-count coefficient table where ranges of cumulative value of the ink consumption count C are associated with values b1-b3 of the thermal control count coefficient b, and the CPU 57 operates to select one of the values b1-b3 which corresponds to the current cumulative value of the ink consumption count C.

On the other hand, when a negative decision (NO) is obtained in step S68, the flow goes to step S72 whether the cumulative value of the ink consumption count C is not lower than the second threshold C2 but lower than a third threshold C3. When an affirmative decision (YES) is obtained in step S72, the flow goes to step S74 in which the value b2 is selected from the thermal-control-count coefficient table.

When a negative decision (NO) is obtained in step S72, the value b3 is selected from the thermal-control-count coefficient table, in step S78.

Once having selected a value of the thermal control count coefficient b, the CPU 57 updates the thermal control count k, in step S80. The updating is made such that a product of the ink consumption count C as calculated in step S50 and the selected values of the temperature coefficient a and the thermal control count coefficient b is added to the previous value $k_0$ of the thermal control count k, and the thus updated value is stored as the current thermal control count k.

The flow then goes to step S82 in which the CPU 57 determines whether the current or updated thermal control count k exceeds a reference value kc, that is, whether the temperature difference between the two places on the printhead 30 is larger than 5° C. When a negative decision is made in step S82, that is, when it is determined that the temperature difference does not exceed 5° C., a normal print mode where the start of the next printing is not deferred is established and in step S84. On the other hand, when an affirmative decision (YES) is made in step S82, that is, when its is determined that the temperature difference exceeds 5° C., the flow goes to step S86 to establish a heat-generation inhibiting mode where the start of the next printing is deferred. FIG. 20 illustrates a flow of the printing control under the heat-generation inhibiting mode.

When the heat-generation inhibiting mode is established, it is determined whether the thermal control count k not lower than a first threshold k1 and lower than a second threshold k2, in step S88. When an affirmative decision (YES) is obtained in step S88, a value D1 of the delay time D, by which start of the next printing is deferred, is selected and set in a timer in step S90. Thus, the start of the next printing is deferred by D1 during which the printhead 30 cools down by itself. The ROM 43 stores a delay time table where a plurality of ranges of the thermal control count k are associated with values D1-D3 of the delay time D, and the CPU 57 selects one of the values D1-D3 corresponding to the current value of the thermal control count k.

In the subsequent step S92, the CPU 67 selects a value β1 of a subtraction coefficient β. The subtraction coefficient β is a coefficient for diminishing the thermal control count k, and corresponds to the set delay time D; that is, a plurality of values β1-β3 of the subtraction coefficient β are predetermined to respectively correspond to the values D1-D3 of the delay time D. Such a subtraction coefficient β is provided in view of the fact that there occurs a situation that the start of the next printing is deferred even after the temperature difference between the two places on the printhead 30 has been lowered below 5° C., if the value of the thermal control count k as obtained in step S80 is kept as it is. The multiplication of the thermal control count k by the subtraction coefficient β results in subtraction of a value corresponding to the selected delay time D from the thermal control count k, enabling to prevent occurrence of the above-mentioned situation.

The ROM 43 stores a subtraction coefficient table where the values D1-D3 of the delay time D are associated with the values β1-β3 of the subtraction coefficient β, and the CPU 57 selects one of the values β1-β3 corresponding to the currently set delay time D, from the subtraction coefficient table.

On the other hand, when a negative decision (NO) is obtained in step S88, the flow goes to step S94 to determine whether the thermal control count k is not lower than the second threshold k2 but lower than a third threshold k3. When an affirmative decision (YES) is obtained in step S94, the CPU 57 selects the value D2 from the delay time table and set it in the timer in step S96 and then selects the value β2 from the subtraction coefficient table in step S98.

When a negative decision (NO) is obtained in step S94, it is determined in step S100 whether the thermal control count k is lower than the third threshold k3. When an affirmative decision (YES) is obtained in step S100, the value D3 is selected from the delay time table and set in the timer in step S102 and then the value β3 is selected from the subtraction coefficient table in step S104.

Once having set the delay time D and selected a value of the subtraction coefficient β, the CPU 57 selects one of a plurality of values of a temperature coefficient α which corresponds to the current value of the environmental temperature T, in step S106. That is, the ROM 43 stores a second temperature-coefficient table where a plurality of ranges of the environmental temperature T are associated with a plurality of values of the temperature coefficient α, and the CPU 57 selects one of the values of the temperature coefficient α corresponding to the current value of the environmental temperature T from the second temperature-coefficient table. The values of the temperature coefficient α in the second temperature-coefficient table are different from those of the temperature coefficient a stored in the first temperature-coefficient table as used in the print-mode determination processing illustrated in FIG. 19. This is based on that the degree of the effect of the environmental temperature T on the temperature difference between the two places on the printhead 30 varies depending upon whether the temperature of the printhead 30 is rising or dropping, and thus there are required two kinds of temperature coefficient tables to accurately control the timing of cooling the printhead 30 and the duration of the cooling.

The CPU 57 then updates the thermal control count k in step S108. This updating in step S108 is made such that a product of the ink consumption count C as calculated in step S50 and the values of the temperature coefficient α and the subtraction coefficient β, is subtracted from the thermal control count k, and the thus updated value is stored as the current value of the thermal control count k.

Through the above-described steps, there is obtained a basic value ($k_0+C\cdot a\cdot b-C\cdot\alpha\cdot\beta$) of the thermal control count k, based on which the thermal control count k is obtained in the next printing.

Once the delay time D, i.e., one of D1-D3, has been set as described above, an affirmative decision (YES) is obtained in step S8 (FIG. 18), that is, it is determined that the delay time D is set, and the flow goes to S10 to determine whether the timer counting down the delay time D is in operation When a negative decision is obtained in step S10, that is, when it is determined that the timer is not in operation, the timer is started to count down the delay time D1-D3, in step S12. In the next step S14, it is determined whether the delay time D1-D3 lapses. When an affirmative decision (YES) is obtained in step S14, that is, when it is determined that the delay time D lapses, the flow goes to step S16 to start printing based on the plurality of data units received in step S6.

As described above, each time printing of a single page of paper sheet is complete, the CPU 57 calculates the ink consumption count C and further corrects the calculated ink consumption count C for compensating for the effects of the environmental temperature and the ink consumption thereon. When the corrected ink consumption count C or the currently obtained value of the thermal control count k is above its reference value, that is, when the current value of the thermal control count k is above the reference value kc, a length of delay time corresponding to the size of the value of the thermal control count k is set and the start of the next printing is deferred by the delay time, thereby cooling the printhead 30 so that the temperature difference between the two places lowers below 5° C. When the delay time lapses, the next printing is started, as shown in FIG. 18.

When the thermal control count k is not above the reference value kc, the next printing is continuously performed, without intermission.

Effects of the Fourth Embodiment

According to the inkjet printer 1 of the fourth embodiment, the temperature difference between the two places E3, E4 on the printhead 30, one E3 of which corresponds to the central portion of the nozzle row 33*a* for yellow ink which is the nearest the IC chip 80 while the other E4 of which corresponds to the uppermost stream portion, with respect to the ink supply, of the nozzle row 33*d* for black ink which is the farthest from the IC chip 80, is prevented from exceeding 5° C. during printing, since otherwise the print quality may deteriorate.

Thus, an inkjet printer capable of preventing degradation in the print quality due to an excessively large temperature difference between the places E3, E4 is provided.

Since the increment in the thermal control count k can be appropriately determined correspondingly to the ink consumption count C, the time duration of cooling the printhead can be accurately and precisely adjusted. Further, since the decrement of the thermal control count k can be determined correspondingly to the set delay time, the time assigned to the next printing is prevented from being unnecessarily long.

The arrangement that the thermal control count k is increased and decreased with weighting based on the environmental temperature T enables the thermal control count k to be adapted to the current environmental temperature T. Thus, the time duration of cooling the printhead is adjusted according to change in the environmental temperature, to have always a suitable length.

While the thermal control count k is smaller than the reference value kc, when printing on a page is complete, the printing on the next page is started immediately, without intermission or delay time. The efficiency of printing is thus enhanced.

Since the reference value kc of the thermal control count k corresponding to the ink consumption is determined such that the temperature difference between two specific places does not exceed a critical value above which the print quality deteriorates, and this specific two places are both on the print head 30, the thermal control count k is increased and decreased while accurately reflecting the temperature of the printhead 30, and the distribution or variation of the temperature on the printhead 30. Therefore, the inkjet printer can complete printing on each page by taking an appropriate time which is not too long or too short.

Fifth Embodiment

There will be described a fifth embodiment of the invention which is applicable to each of the above-described embodiments, in part of which (namely, the first through third embodiments) the next printing is deferred when the ink consumption C for printing on a single page of paper sheet exceeds its reference value C1, and in another of which (namely, the fourth embodiment) the next printing is deferred when the thermal control count k exceeds its reference value kc. Although the fifth embodiment is described below as the fifth embodiment is a modification of the fourth embodiment where the thermal control count k is used in determining whether to defer the next printing or not, for convenience, it is possible to consider the following embodiment to be a modification of each of the first through third embodiments in which the ink consumption C is used in this determination, when the words "thermal control count k" is replaced by "ink consumption C" and the words "reference value kc" is replaced by "reference value C1 of the ink consumption", where appropriate, in the description below.

Figure 21:
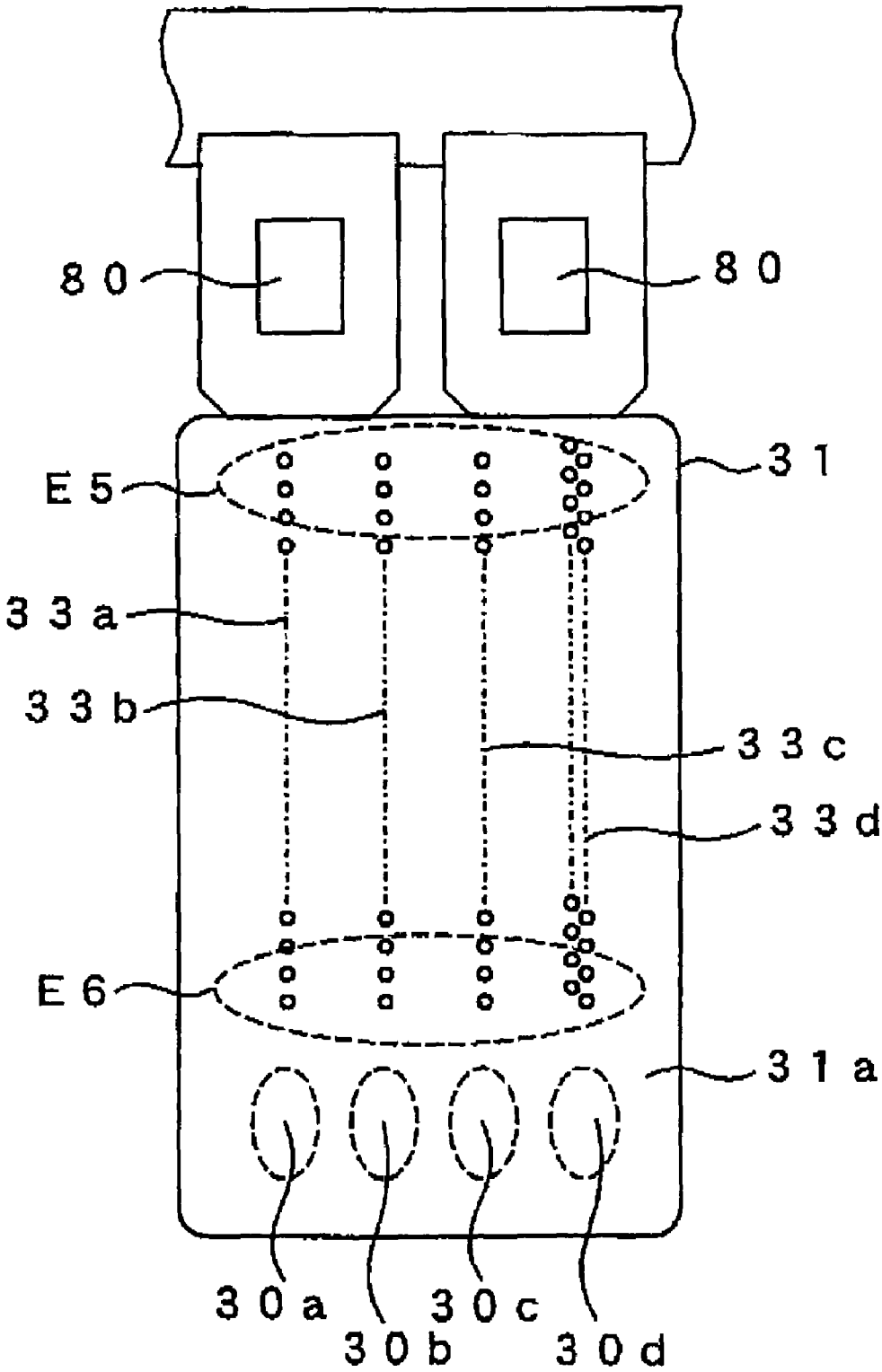
FIG. 21 is a bottom plan view of an inkjet printer according to a fifth embodiment of the invention, as seen from the side of a nozzle surface of its inkjet printhead, showing a positional relationship between IC chips and the printhead.

FIG. 21 is a bottom view of an inkjet printer according to the fifth embodiment, as seen from a nozzle surface of its printhead 30, and shows a positional relationship between IC chips 80 and the printhead 30. That is, the inkjet printer has two IC chips 80, 80 which drive respective actuators and are disposed at a position the most remote from ink supply ports 30*a*-30*d*, i.e., on the lowermost stream side of the printhead 30 with respect to ink supply into the printhead 30. In this printer, the temperature of the printhead at a place E5 and at a place E6 which are respectively at the uppermost stream side and at the lowermost stream side with respect to the ink supply, is in question when calculating a thermal control count k in the same way as described above with respect to the fourth embodiment. In the printing operation with the present printer, the above-described printing control is performed to prevent the temperature difference between the places E5 and E6 from exceeding 5° C., a temperature difference above which may cause deterioration in the print quality, with occurrence of banding and a white line, for instance. Therefore, the print quality is enhanced according to the fifth embodiment.

Sixth Embodiment

In the above-described first through fifth embodiments, the printing control is performed based on the data obtained in the experiments conducted for the places E3 and E4 on the printhead 30 with respect to the value of the temperature difference therebetween which causes degradation in the print quality. However, the two places temperature difference of which is in question may be two places each corresponding to one of nozzle rows.

Figure 22:
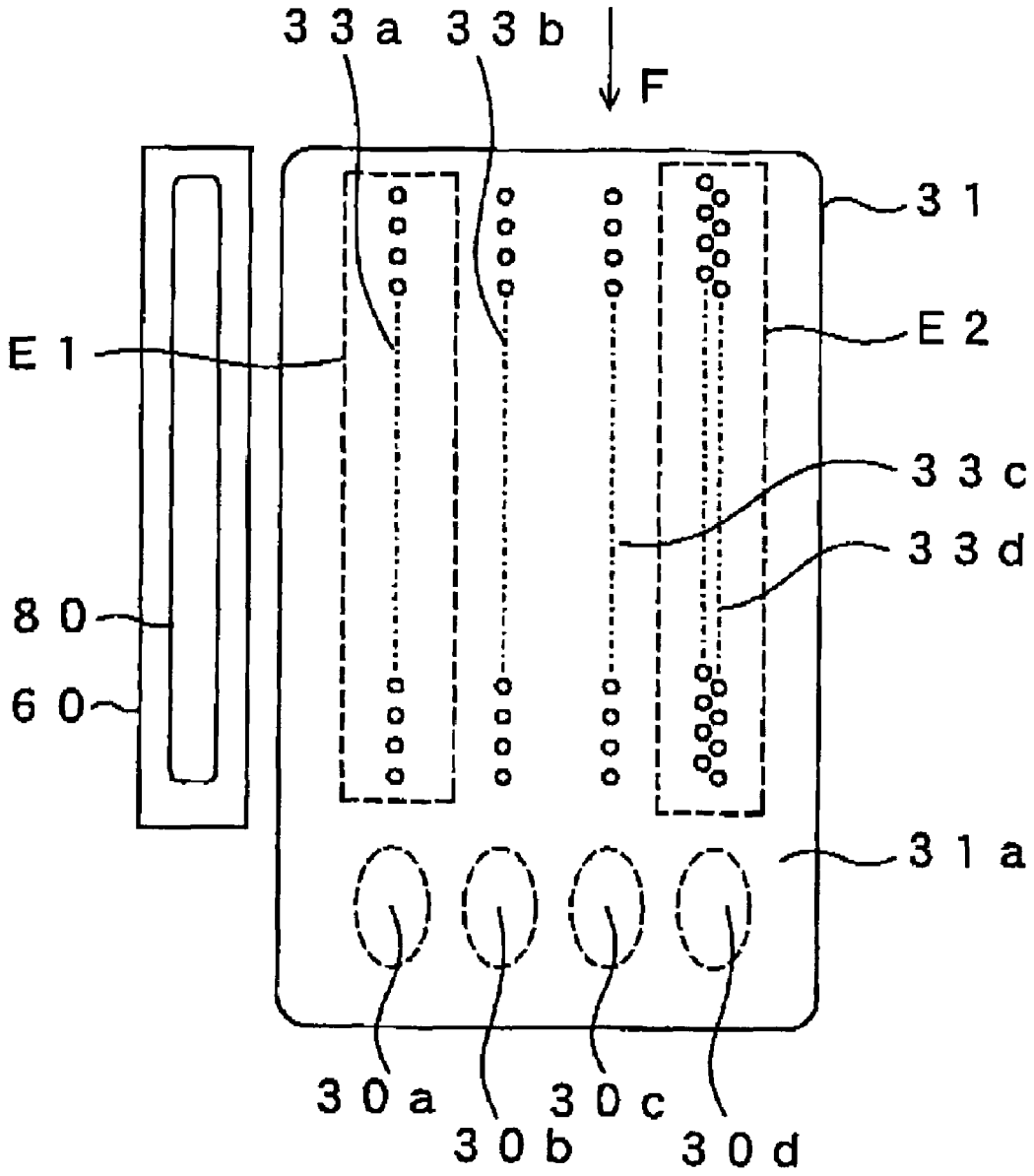
FIG. 22 is a bottom plan view of an inkjet printer according to a sixth embodiment of the invention, as seen from the side of a nozzle surface of its inkjet printhead, showing a positional relationship between an IC chip and the printhead.

An example of such an arrangement is shown in FIG. 22, which is a bottom view of a printhead 30 of an inkjet printer according to a sixth embodiment of the invention. As shown in FIG. 22, the two places of interest are places E1 and E2, according to the sixth embodiment. That is, an experiment similar to the above-described one is conducted with respect to the temperature difference between the places E1, E2, and a control of printing is executed based on data obtained in the experiment. As the temperature at each of the places E1, E2, there may be employed, for instance, (i) a mean value of the temperatures at a plurality of portions in the place E1, E2, or (ii) the temperature at a central portion of nozzle row 33*a*, 33*d*.

The inkjet printer is capable of preventing degradation in the print quality due to an excessively large temperature difference between a place on the printhead which corresponds to one of all the nozzle rows which is the nearest an IC chip 80, and another place on the printhead corresponding to the farthest one of the nozzle rows from the IC chip 80.

The two places whose temperature difference is measured or in question may be selected such that one of them is on the printhead 30, while the other is not on or in the printhead 30. That is, as long as the two places are such places that a temperature difference on the printhead 30 is detectable or estimatable based on the temperature of the places, it is not essential that both of the two places are on the printhead 30. For instance, in the arrangement shown in FIG. 22, one of the two places may be outside or off the printhead 30 and near the IC chip 80.

The reference value of the temperature difference varies depending on where the two places in question are located. Further, the reference value of the temperature difference varies depending on other factors also, such as the structure of the inkjet printer and particularly of the printhead, the kind of the ink used, and the condition under which the printing is performed. Generally, however, the reference value of the temperature difference is desirably selected from a range of 5° C. to 8° C.

Seventh Embodiment

Figure 23:
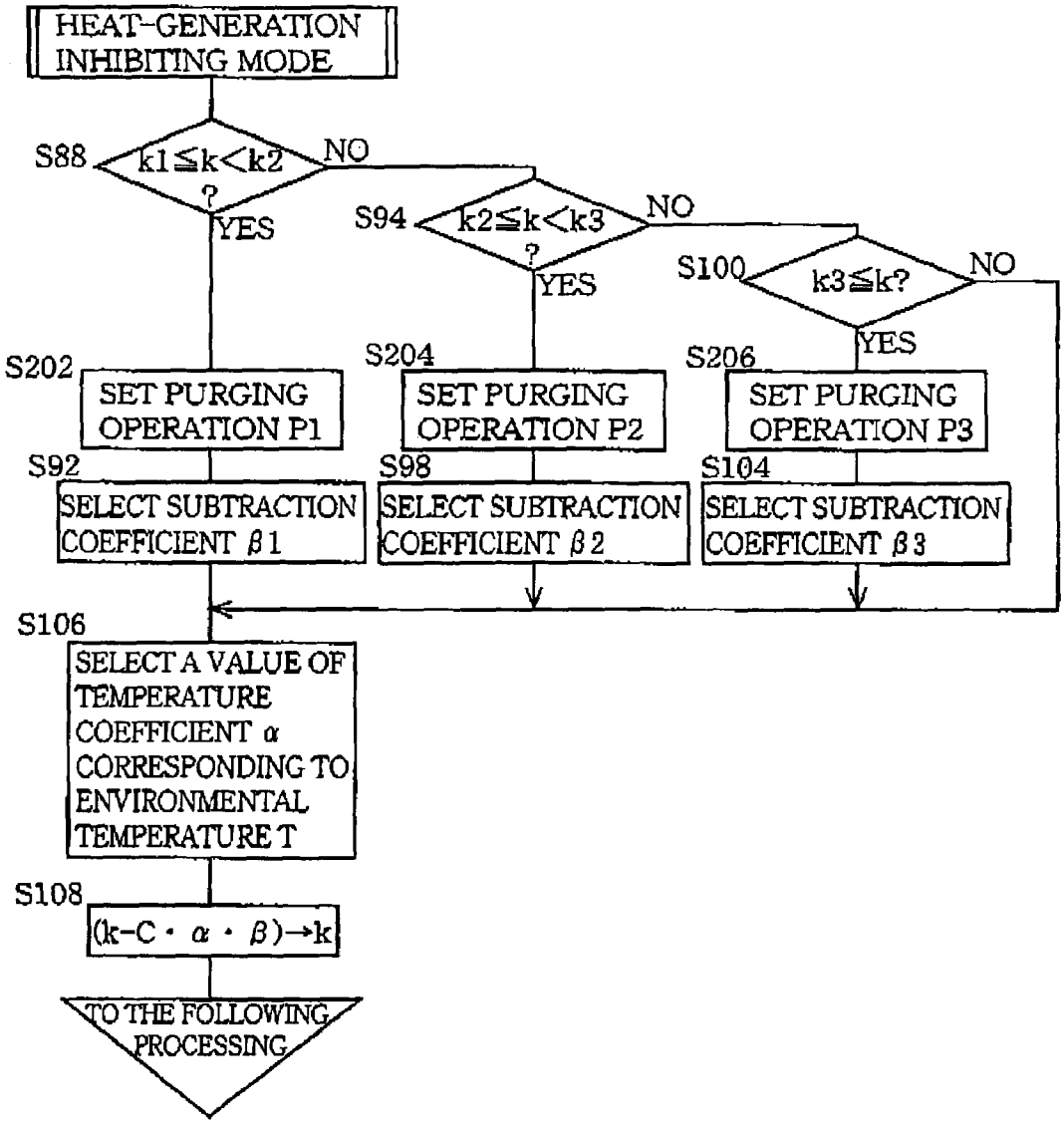
FIG. 23 is a flowchart illustrating a part of a printing control executed by a CPU in an inkjet printer according to a seventh embodiment of the invention.
Figure 24:
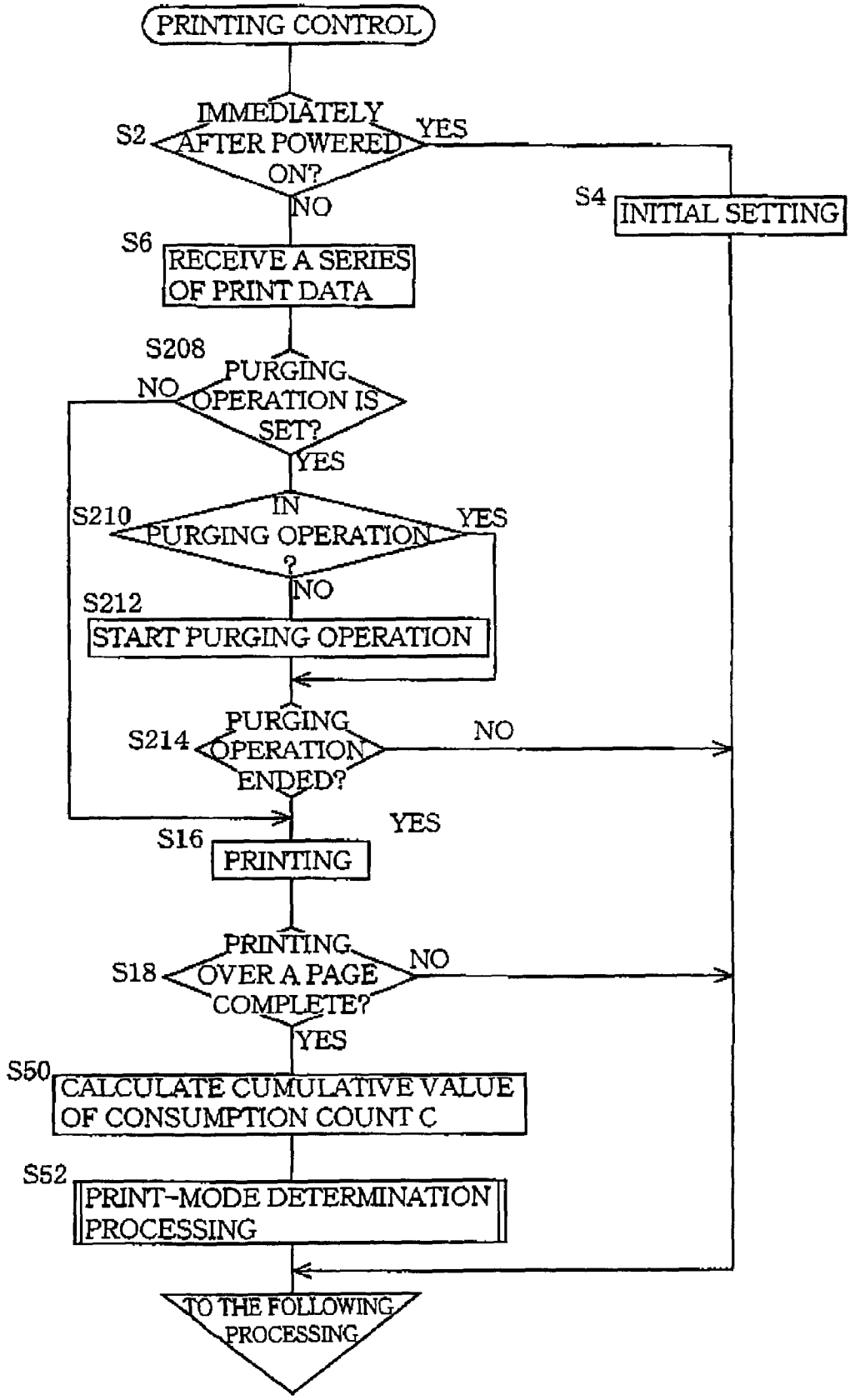
FIG. 24 is a flowchart is a flowchart illustrating another part of the printing control executed by the CPU.

It may be arranged such that a purging operation is performed during the delay time by which the start of the next printing is deferred for cooling down the printhead 30. In other words, a purging operation may be performed after printing on a single page is complete, so as to defer the start of the printing on the next page in order to cool the printhead 30. An example of such an arrangement is illustrated in a flowchart of FIG. 23, which is a flowchart of a control of printing executed by an inkjet printer according to a seventh embodiment of the invention. In the printing control, the flow of the printing control according to the fourth embodiment is modified such that steps S90, S96, 8102 implemented in the printing operation under the heat-generation inhibiting mode as illustrated in FIG. 20 (namely, the processing to set the delay times D1, D2, D3) are respectively replaced with steps S202, S204, S206 for setting purging operations P1, P2, P3 as shown in FIG. 23, while steps S8, S10, S12, S14 shown in FIG. 18 are respectively replaced with steps. S208, S210, S212, S214 as shown in FIG. 24. The purging operations P1, P2, P3 are such that in each purging operation P1, P2, P3, purging of a same given duration is performed, but the total durations of the respective purging operations P1, P2, P3 differ and respectively correspond to the values D1-D3 of the delay time D, namely, the total duration of the purging operations P1, P2, P3 increases in this order. In other words, a period of time taken by an entirety of each purging operation P1, P2, P3 is longer than the given duration of the purging. The redundant time in each purging operation P1, P2, P3 is simply allowed to elapse, during which the printer is held in a wait state so as to sufficiently cool the printhead before the start of the next printing.

More specifically, in step S208 in the printing control, it is determined whether any purging operation P1, P2, P3 is set, and when an affirmative decision is made in step S208, the control flow goes to S210 to determine whether the purging operation P1, P2, P3 is being performed. When a negative decision is made in step S210, the purging operation P1, P2, P3 is started. When an affirmative decision is made in step S210, and when the step S212 is implemented, the flow goes to step S214 to determine whether the purging operation P1, P2, P3 is ended. On the other hand, when a negative decision is made in step S208, the flow skips steps S208-214. The other part of the printing control according to the seventh embodiment is identical with that of the fourth embodiment.

According to this printing control, the time for cooling the printhead can be effectively utilized.

However, the purging is not always required to be actually performed even when any of the purging operations P1, P2, P3 is set. For instance, the printing control may be adapted as follows:

(1) Where the total duration of some of the purging operations P1, P2, P3 is longer than the given duration of the purging, the purging of the given duration is actually performed. However, the purging of the given duration is not actually performed when any of the other(s) of the purging operations whose total duration is not longer than the given duration of the purging is set and implemented.

(2) Even when the printhead is required to be cooled, until a predetermined time elapses after the last purging, the steps for performing the purging before the start of the printing are not implemented, or, the setting any of the purging operations P1, P2, P3 is not implemented, but merely an appropriate delay time is allowed to elapse.

In view of the fact that it suffices that purging is performed only when required, for instance, when inconvenience is likely to be caused due to the bad ink in the nozzles, and also, performing the purging too many times leads to waste of ink, the arrangement (2) is desirable.

The purging operation may be replaced with any one or plurality of the following operations: a flushing operation for discharging bad ink in nozzles, a wiping operation in which a wiper wipes off ink adhering to a nozzle surface, and an air discharging operation for discharging air accumulated in a buffer tank to the outside.

Eighth Embodiment

Figure 25:
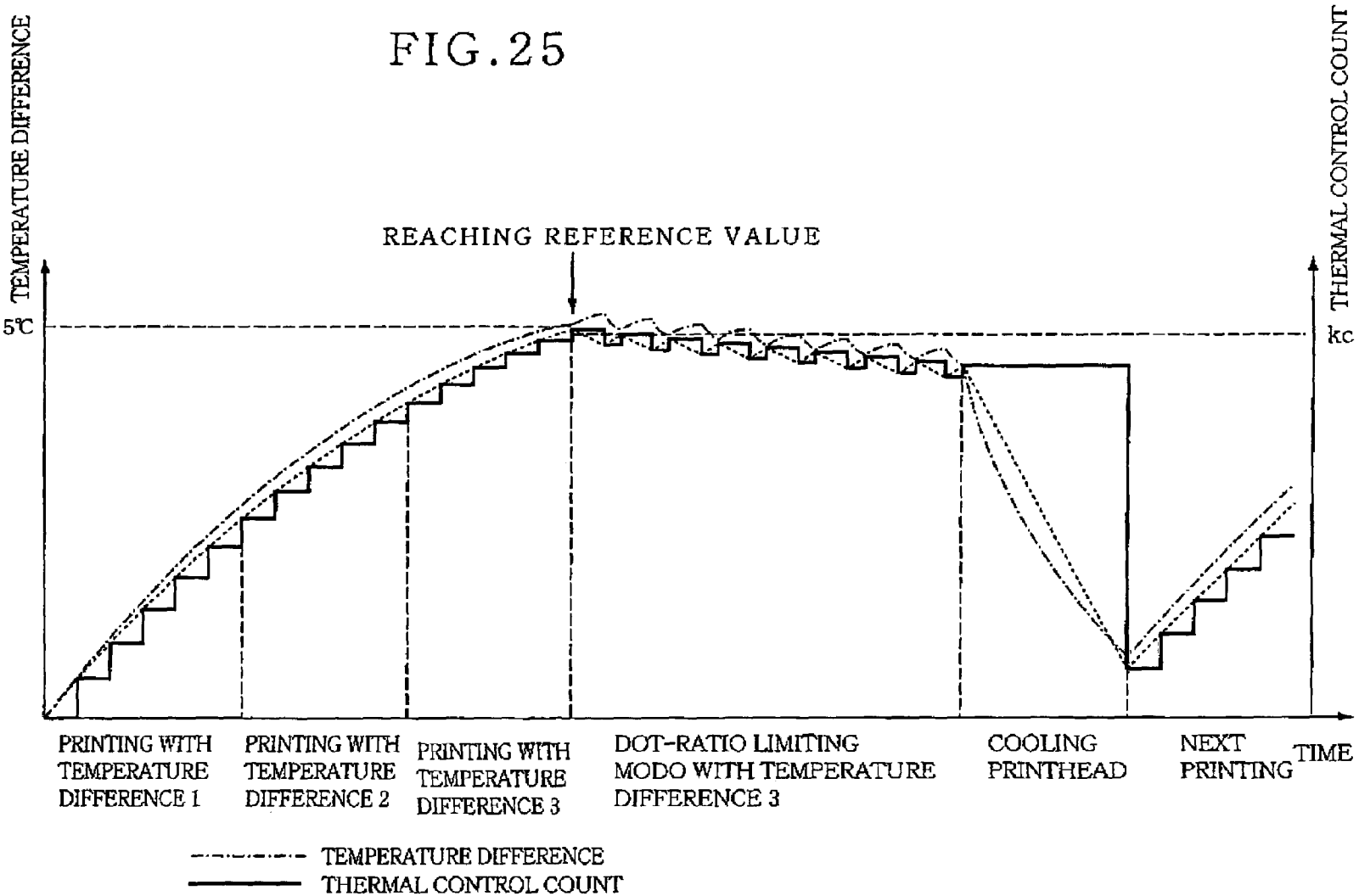
FIG. 25 illustrates an example of the relationship between the value of a thermal control count and the temperature difference between two places, as changed in time, in an inkjet printer according to an eighth embodiment of the invention.

There will be described a printing control in an inkjet printer according to an eighth embodiment of the invention. In FIG. 25, a thermal control count k is plotted versus the temperature difference between two places on a printhead 30 of the printer according to the eighth embodiment. As shown in FIG. 25, when the thermal control count k exceeds a reference value kc, a dot ratio which has been set before the thermal control count k exceeds the reference value kc is changed to a lower value than before, to establish a "dot-ratio limiting mode", in order to prevent the temperature difference between the two places on the printhead 30 from exceeding 5° C. Then, upon completion of the printing on the current page of paper sheet, start of the next printing is deferred to cool the printhead 30.

For instance, the dot ratio is lowered by performing printing such that (i) the nozzle rows each of which is odd-numbered as counted from a side of the alignment of the nozzle rows forms dots while a carriage or head holder is moved in a first direction, e.g., left to right, and the other nozzle rows each of which is even-numbered as counted from the side of the nozzle row alignment forms dots while the carriage is moved in a second or reverse direction, i.e., right to left, or (ii) a part of an image printed with cyan, magenta, yellow inks is formed while the cage is moved in a first direction, e.g., left to right, and the other part of the image printed with black ink is formed while the carriage is moved in a second or reverse direction, i.e., right to left.

According to this printing control, the temperature difference between the two places on the printhead 30 does not exceed the reference value 5° C., during printing is performed, thereby eliminating the possibility for degradation in the print quality.

In the printing control, every time the host computer 71 receives all data units constituting print data for each page of paper sheet, the thermal control count k is calculated Therefore, during the period from the start of the printing to the moment the thermal control count k reaches the reference value kc, that is, the period of printing with temperature difference 1-3 as shown in FIG. 25, the thermal control count k increases in steps. During the dot-ratio limiting mode is established, on the other hand, the thermal control count k decreases in steps since every time the thermal control count k is calculated, a decrement derived from the arrangement to reduce the dot ratio as described above is reflected.

The dot-ratio limiting mode may be established as soon as it is determined that the thermal control count k exceeds the reference value kc whether or not the printing on the current page is incomplete or halfway finished. Alternatively, the dot-ratio limiting mode may be established only after the printing on the current page is complete, that is, it may be adapted such that it is not until the printing on the next page is started that the dot ratio is lowered.

Further, the dot ratio may be varied depending on other factors such as the environmental temperature.

The delay time by which the start of the next printing is deferred may include a time period from a moment the last printing is complete to a moment the nest sheet paper as fed in is positioned at a printing position.

The rate of increase in the temperature difference on the printhead differ depending upon the conditions under which the printing is performed. For instance, the conditions may be: the resolution (dpi), the size of the paper sheet (e.g., A4 and B5), the kind of the paper sheet (e.g., paper sheet exclusively for inkjet printers and regular paper sheet), whether the printing is color printing or monochromatic printing, whether the printing is bidirectional or unidirectional (that is, whether the printing is performed only while the carriage is moved in a specific one of opposite directions or not), and the purpose of the printing (e.g., document and photograph).

Hence, it may be adapted such that a relationship between each of the printing conditions and the temperature difference is obtained beforehand by experiment, and a relationship between each printing condition and a coefficient for compensating for the effect of the printing condition on the temperature difference is stored in the form of a table or otherwise in a ROM or the like, for instance, so that in an actual printing operation, the ink consumption count is multiplied by the coefficient corresponding to the conditions under which the printing operation is performed.

When the printing control is adapted as described above, the effects of the conditions under which the printing is performed on the temperature difference are compensated for, thereby enabling an accurate calculation of the thermal control count irrespectively of variation in the printing conditions. Thus, the printhead can be cooled at further accurate and precise timing, without taking an unnecessarily long cooling time.

Ninth Embodiment

Figure 26:
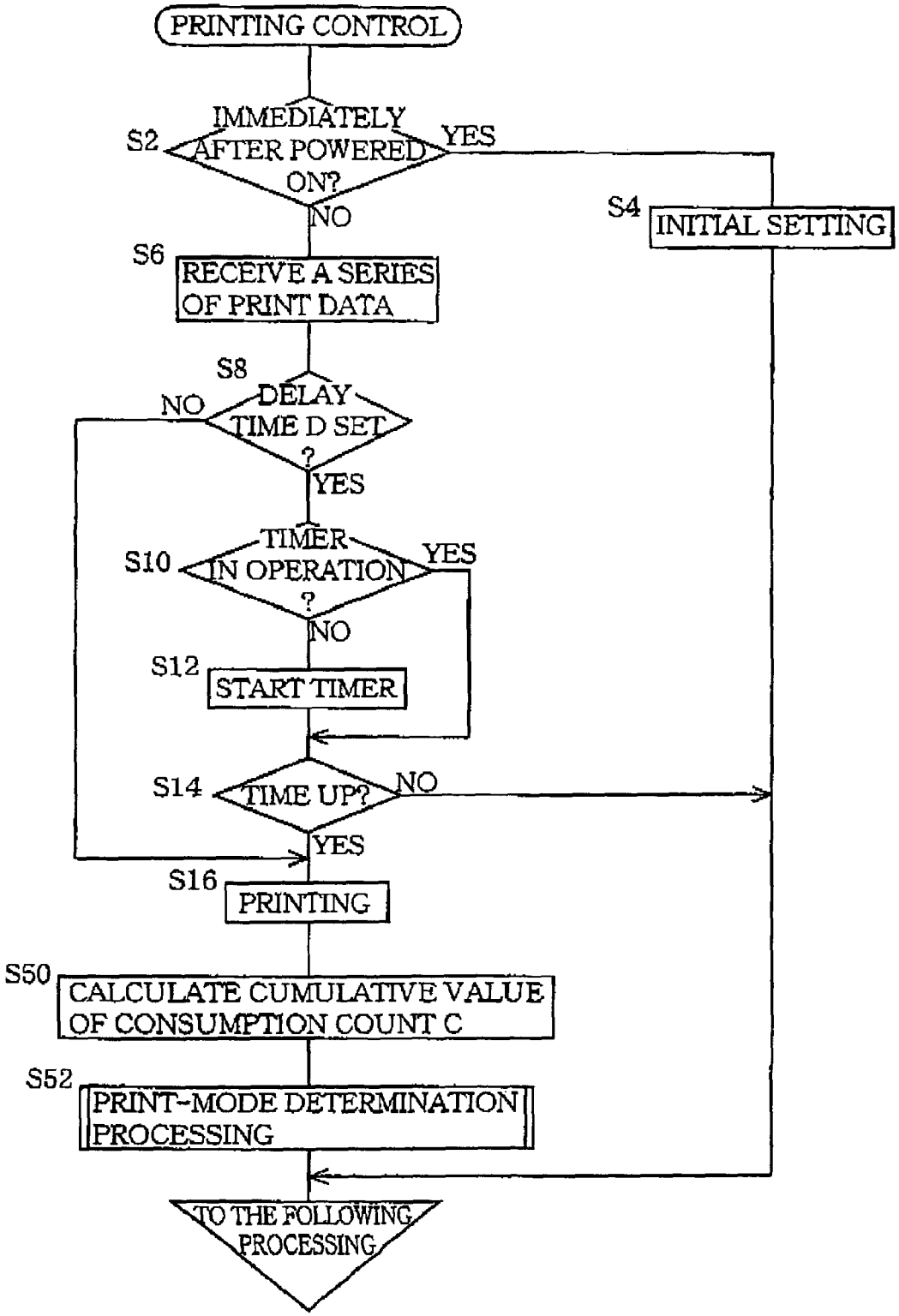
FIG. 26 is a flowchart illustrating a part of a printing control executed by a CPU in an inkjet printer according to a ninth embodiment of the invention.

There will be now described a ninth embodiment of the invention In the printing control implemented by the inkjet printer according to each of the first through eighth embodiments, the thermal control count is calculated for each page of paper sheet, and the delay time not zero is set when the thermal control count exceeds its reference value. However, in the printing control according to the ninth embodiment as shown in FIG. 26, the ink consumption is calculated for each raster, or a plurality of rasters, and a delay time not zero is set when the calculated ink consumption exceeds a reference value. More specifically, in a case where print data is constituted by a plurality of data units each representative of information or image to be printed by taking a given unit time, start of printing based on each of the data units is deferred. A flowchart of FIG. 26 is different from that of FIG. 18 in that step S18 in FIG. 18 is deleted. That is, the step for determining whether or not the printing on the single page is complete is eliminated, and each time a data unit is received in step S6, step S50 and the following steps are implemented, with start of printing based on any data unit deferred, when needed.

According to this printing control, printing is controlled on a raster by raster basis, or, on plural rasters basis so as not to lower the print quality due to an excessively large temperature difference between two places on a printhead.

Tenth Embodiment

Figure 27:
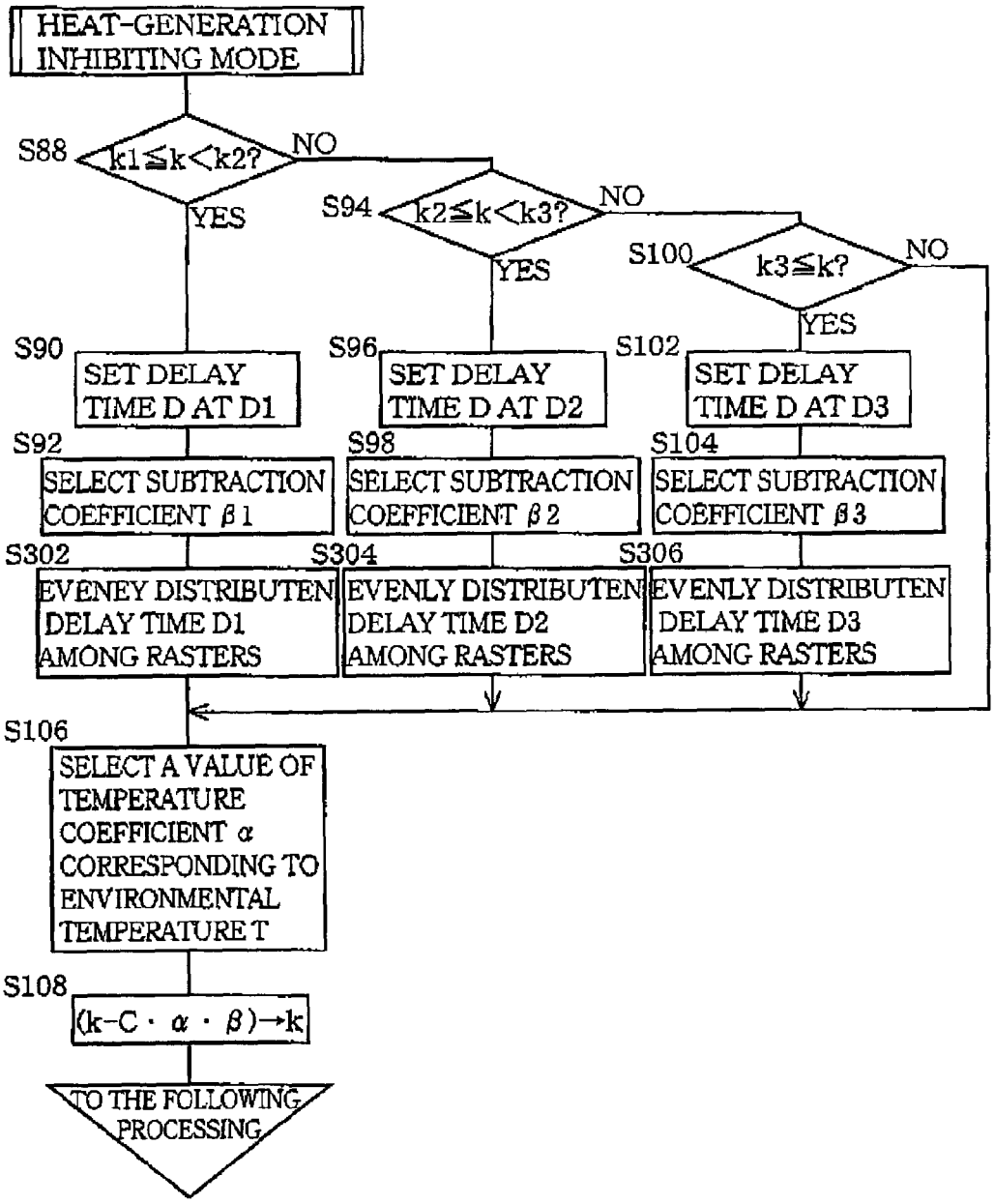
FIG. 27 is a flowchart illustrating a part of a printing control executed by a CPU in an inkjet printer according to a tenth embodiment of the invention.

There will be described a tenth embodiment of the invention, as illustrated in FIG. 27. In the fourth embodiment shown in FIG. 20 the printing control is performed such that the thermal control count is calculated for each page, and when the thermal control count exceeds the reference value, the delay time is set for the next page as a whole. However, in an inkjet printer according to the tenth embodiment, the printing control is adapted such that the delay time is set for each raster, or each of a plurality of rasters.

Figure 20:
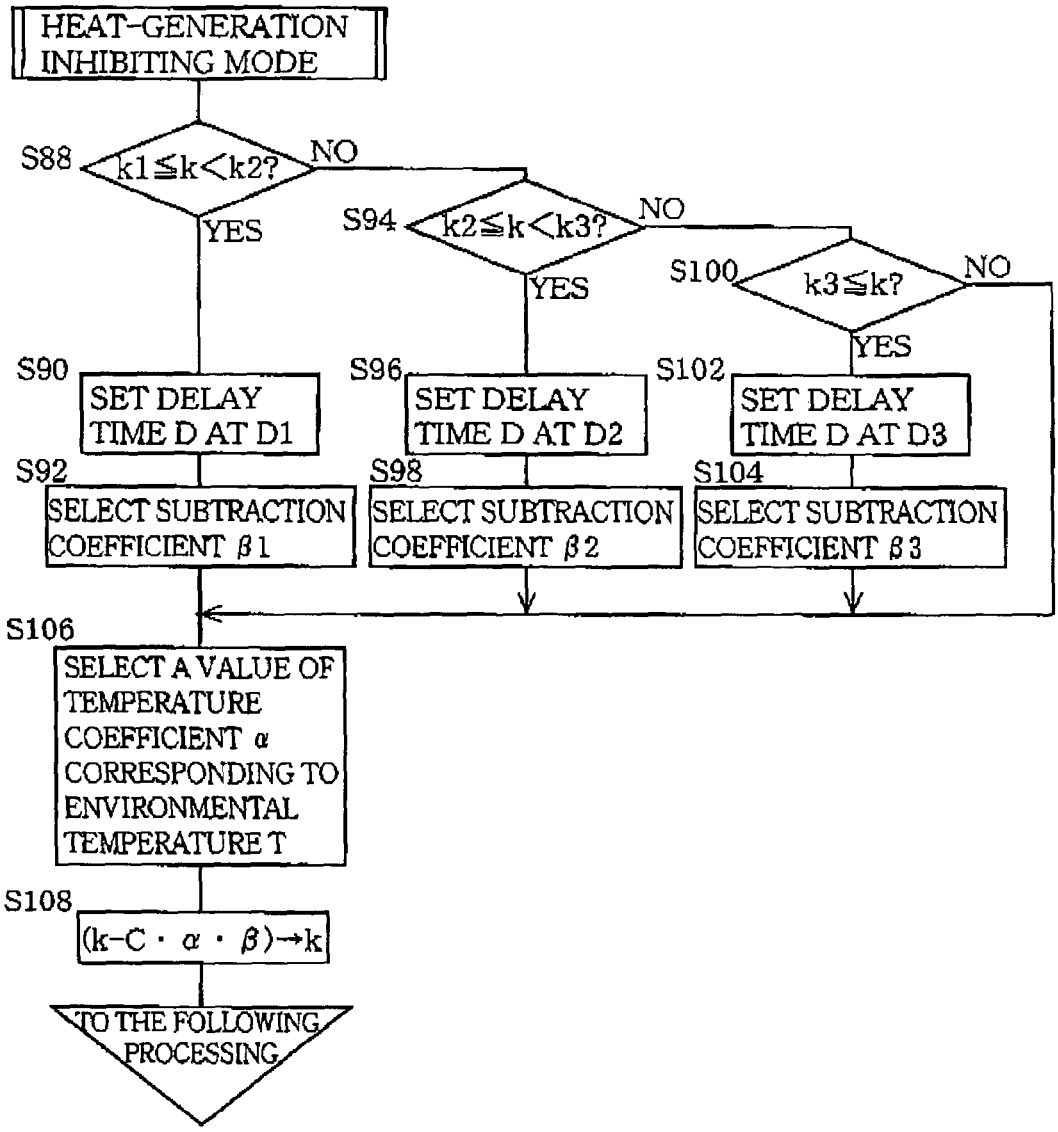
FIG. 20 is a flowchart illustrating a flow of the printing control in a heat-generation inhibiting mode as implemented by the CPU.

In the printing control according to the tenth embodiment, during steps the same as those shown in FIGS. 18-20 are sequentially implemented, a heat-generation inhibiting mode is established like in the fourth embodiment. The heat-generation inhibiting of the present embodiment and that of FIG. 20 are identical in that the delay time D is set according to the range within which the thermal control count k falls, but differ in that the control of the present embodiment further includes steps S302, S304, S306 for evenly distributing a delay time D1-D3 among data units each corresponding to one of rasters constituting a page. More specifically, the thermal control count k is compared with its reference value(s), and based on the result of this comparison, a delay time D1-D3 necessary for the next page is determined. The thus determined delay time D1-D3 is then divided into a plurality of sub delay times of a same length, which are distributed to all of data units constituting print data for the next page. In the present embodiment, each data unit is data for a single raster. According to the embodiment, even when the amount of heat which has been generated during printing over a page of paper sheet is so large that the length of the delay time which should be applied to the printing on the next page is noticeable if applied at once, the delay time is distributed to all the rasters of the next page so that the printing is more continuously performed with less noticeable intermissions for cooling the printhead. The printing on the page after the next is also performed with a required delay time distributed among rasters constituting the page. In this way, a sequence of printing operations is smoothly performed. Thus, printing not causing the operator to feel discomfort is enabled, In the tenth embodiment, it may be adapted such that each of the data units corresponds to a plurality of rasters, not a single raster, and the set delay time is distributed among such data units.

It is noted that the present invention is applicable not only to an inkjet printer using a piezoelectric actuator utilizing an electromechanical transducer such as a piezoelectric element, but also to an inkjet printer having as a drive source an actuator using an electrothermal transducer. Further, the present invention may be applied to an inkjet printer which has an ink cartridge or cartridges on an inkjet printhead, an inkjet printer having a function of scanner and/or a copy function, and an inkjet printer of the type where a printhead is fixed in position.

In each of the embodiments described above, whether the temperature difference between the two places exceeds the reference value is estimated based on the value of the ink consumption or the variable (i.e., the thermal control count k). However, the temperatures of the two places may be actually measured, so that the time taken for completing a given amount of printing is increased based on the result of this actual measurement. For instance, two of the temperature sensor 59 (shown in FIG. 17 and for measuring the environmental temperature) and the temperature sensors 91, 91 for measuring the temperatures of the places E3, E4 which are in the surface of the printhead 30 opposite to its nozzle surface 31*a* provided by a surface of the cavity unit 31 partially constituting the printhead 30.

Eleventh Embodiment

There will be now described an eleventh embodiment of the invention, by referring to FIGS. 28-32. The inkjet printer according to each of the above-described embodiments comprises means for increasing the printing time taken for an amount of printing when the temperature difference between two places at least one of which is on the printhead exceeds the reference value, in order to prevent degradation in the print quality. Meanwhile, an inkjet printer according to the present embodiment further comprises means for increasing the printing time when the temperature of the printhead exceeds a reference value, in order to prevent degradation in the print quality.

Figure 28:
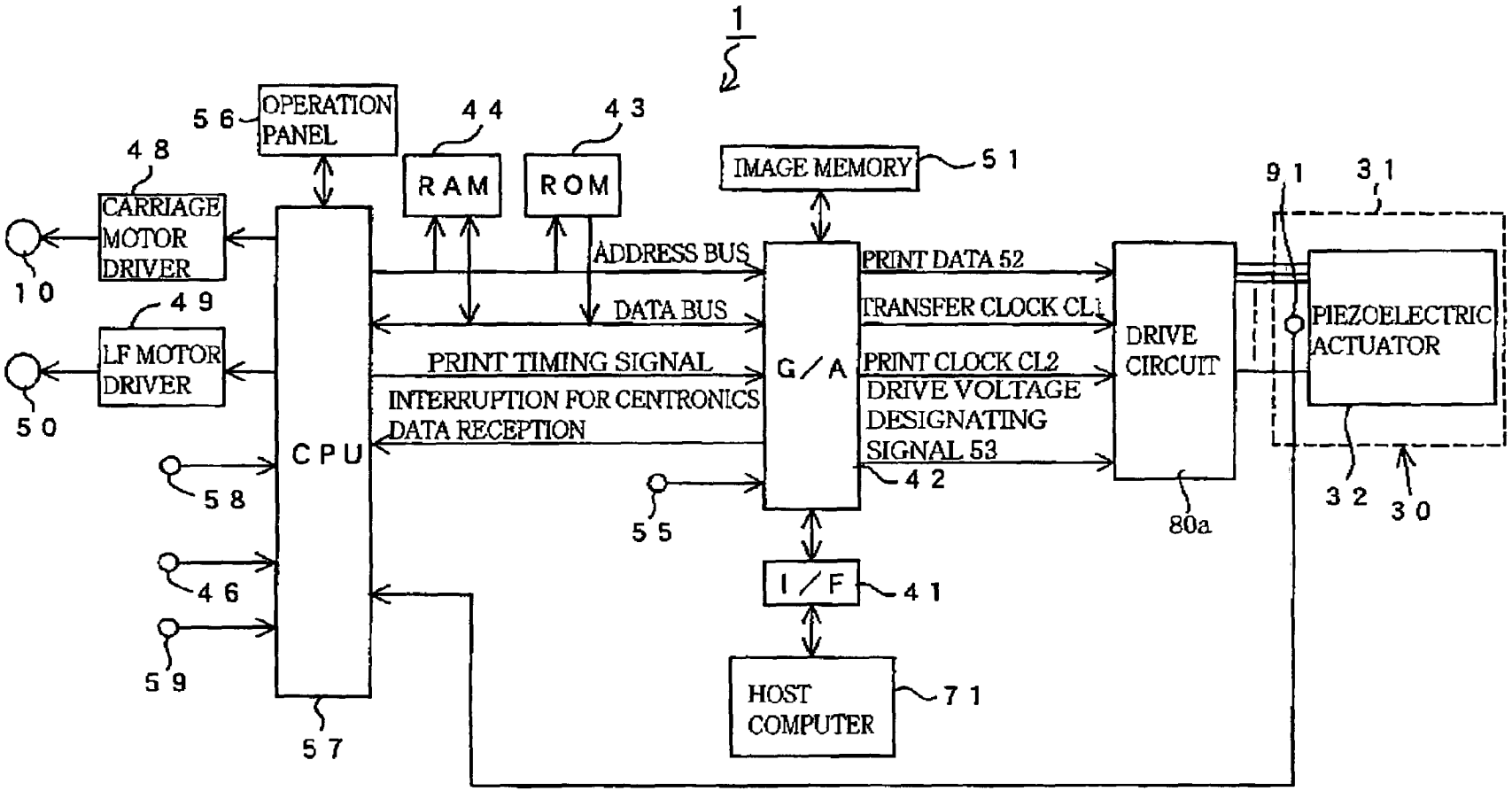
FIG. 28 is a block diagram showing a general structure of a control system of an inkjet printer according to an eleventh embodiment of the invention.
Figure 29:
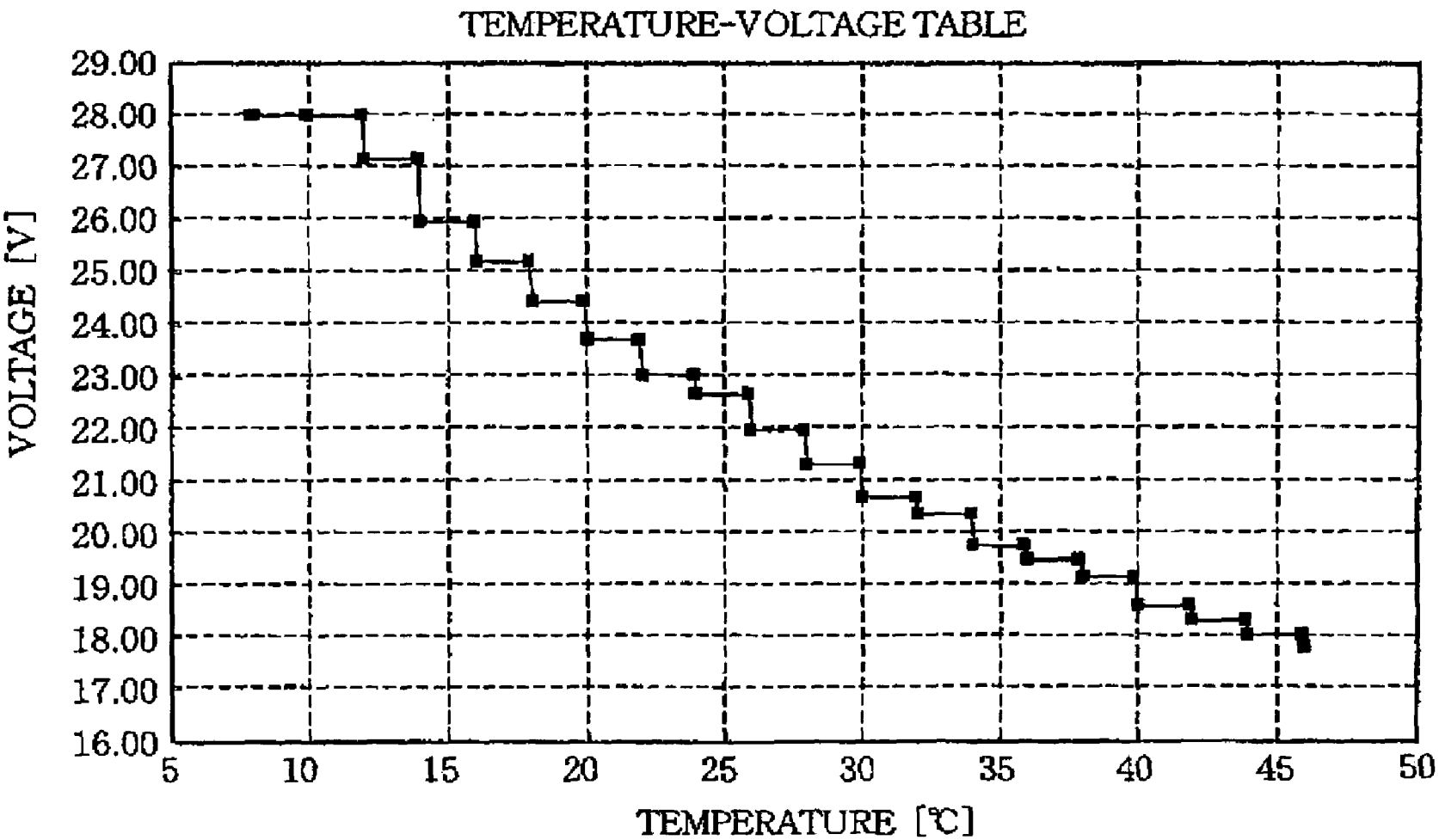
FIG. 29 is a graph showing a relationship between the temperature of a printhead and the voltage to be applied to an actuator, in a printing control by the control system of the FIG. 28.

FIG. 28 shows a control system of the inkjet printer of this embodiment. This control system is basically identical with that in FIG. 17, but different in that a drive voltage designating signal 53 is supplied from a gate array 42 to a drive circuit 80*a*, and that a CPU 57 determines the value of a drive voltage to be applied to an actuator by referencing a temperature-voltage table where a relationship between the temperature of the printhead 30 and the drive voltage, and based on the temperature of a printhead 30 measured by a temperature sensor 91. The value of the drive voltage thus determined is passed to the drive circuit 80*a* via the gate array 42.

Figure 30:
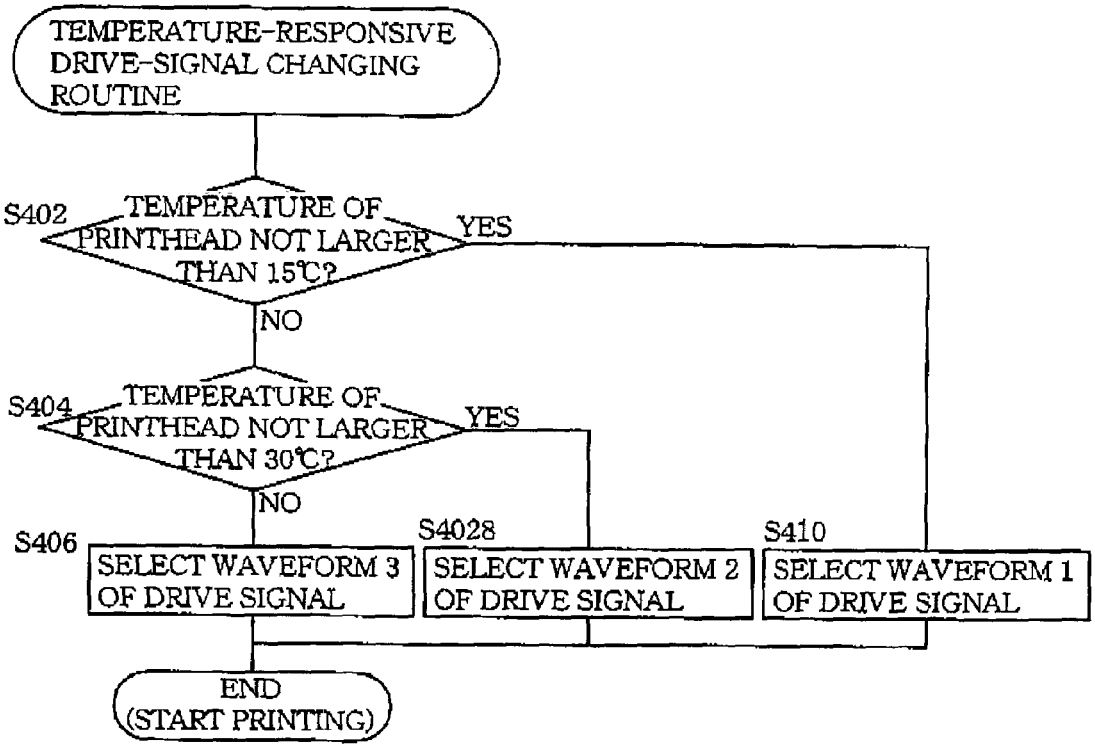
FIG. 30 is a flowchart illustrating a temperature-responsive drive signal changing routine executed by a CPU of the control system of FIG. 28.
Figure 31:
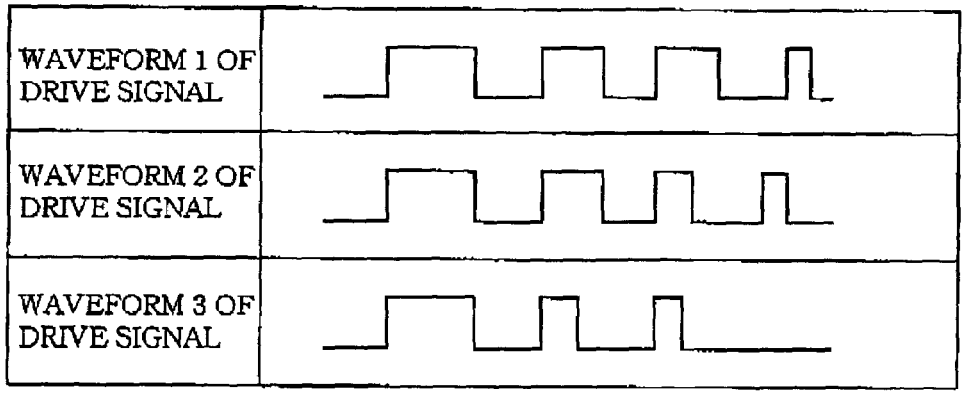
FIG. 31 is an example of waveforms of a drive signal which is changed in the temperature-responsive drive signal changing routine of FIG. 30.
Figure 32:
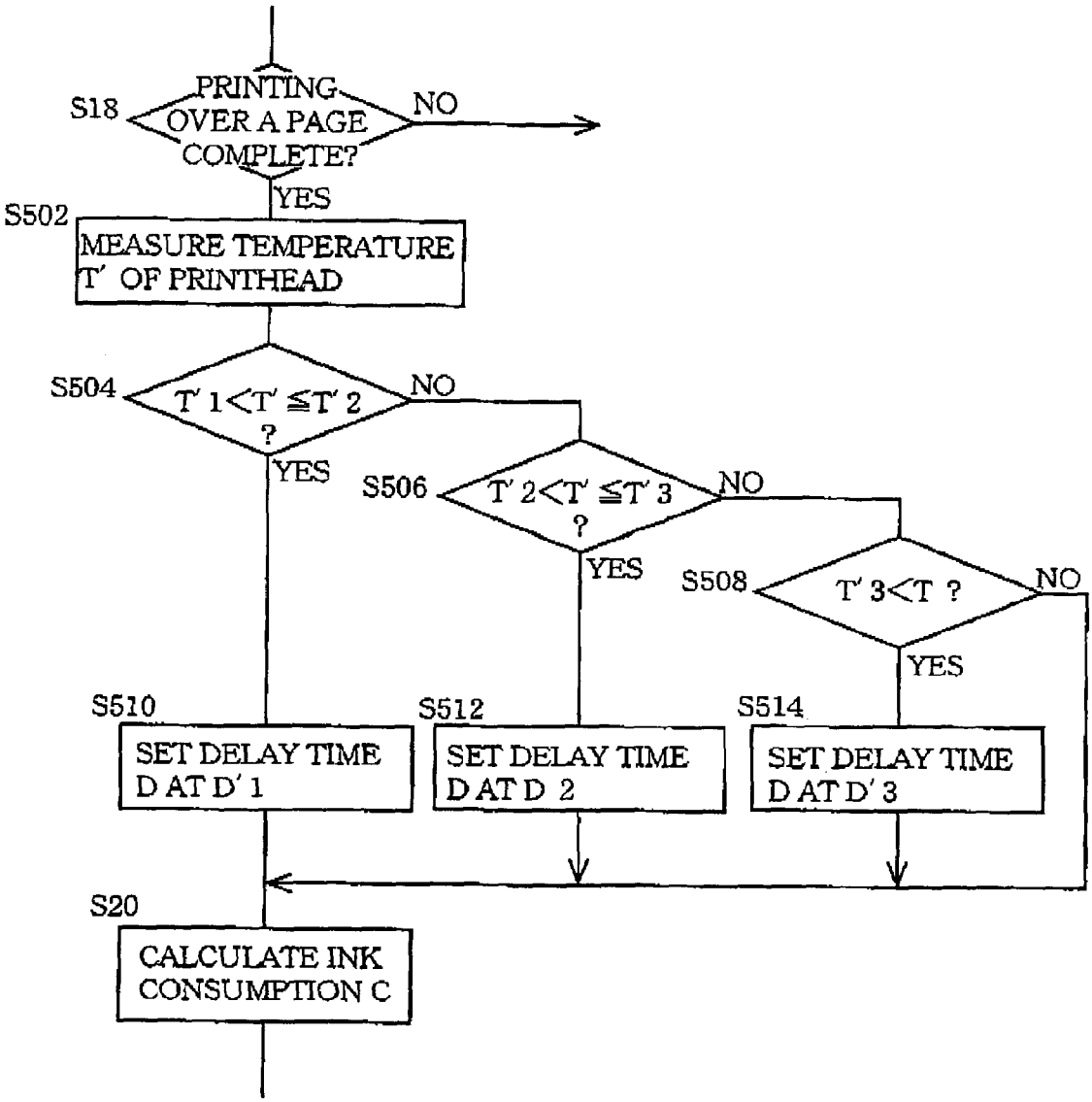
FIG. 32 is a flowchart illustrating a part of a printing control executed by a CPU in the control system of FIG. 28.

The CPU 57 further executes-program routines shown in FIGS. 30 and 32. The routine shown in FIG. 30 (i.e., a temperature-responsive drive-signal changing routine) is executed for changing the waveform of drive signals supplied to the actuator, according to the temperature of the printhead 30. This routine is provided to change the pulse train of the drive signals as well as to change the drive voltage as described above, since the changing the drive voltage is not sufficient to respond to the change in the ink viscosity due to the change in the temperature of the printhead 30. In the present embodiment, the pulse train is changed only for each droplet of large size which is particularly subject to the temperature of the printhead, in three steps as shown in FIG. 31, that is, there are three waveforms 1-3 to be selected according to the temperature of the printhead 30. However, the pulse train of the drive signal for all of large, medium, and small droplets may be changed according to the temperature of the printhead. The routine is as follows. There are predetermined three ranges of the temperature of the printhead 30, namely, a first range not higher 15° C., a second range higher than 15° C. but not higher than 30° C., and a third range higher than 30° C. In steps S402, S404 of the routine, it is determined within which one of the ranges the temperature of the printhead 30 falls. Base on the result of the determination, one of the waveforms 1-3 is selected in steps S406, S408, S410.

The routine or flowchart of FIG. 32 is basically identical with that of FIG. 18, except that the flowchart of FIG. 32 further includes steps S502-S514 between steps S18 and S20. More specifically, the temperature of the printhead which is represented by T' is measured in step S502, by means of the temperature sensor 91. The flow then goes to steps S504-S508 in which it is determined within which one of three ranges defined by thresholds T'1, T'2, T'3 (T'1<T'2<T'3) the temperature T' falls. Then; in steps S510, S512, S514, a delay time D for a page is set at one of D'1, D'2, D'3 (D'1<D'2<D'3), based on the determination. Where the temperature T' does not exceed the threshold T'1, a delay time is not applied, namely, the delay time D is set at zero. That is, T'1 is the reference value of the temperature of the printhead.

The flowchart of FIG. 32 is designed assuming that it does not occur at the same time that the temperature difference ΔT between the two places exceeds the reference value and that the temperature T' of the printhead 30 exceeds the reference value T'1. Normally, the above assumption is correct and thus the above-described flowchart suffices. However, in specific situations, such as where the inkjet printer is used in an environment where the temperature is relatively high, and where the inkjet printer starts and continues printing at an extremely high dot ratio immediately after powered on, the above-mentioned two events may occur at the same time. In this case, steps S8-S14 as shown in FIG. 18 are modified such that in these steps the delay time D set upon the temperature difference ΔT exceeding its reference value, and the delay time D' set upon the temperature T' of the printhead exceeding its reference value are compared with each other, and the longer one of the delay times D, D' is employed to be applied to the next printing.

What is claimed is:

1. An inkjet printer comprising:

an inkjet printhead having an actuator, and a plurality of nozzle rows each consisting of a plurality of nozzles through each of which a droplet of ink is ejected onto a recording medium by driving of the actuator;

an IC chip having a drive circuit for outputting a drive signal to the actuator based on print data so that the ink droplet is ejected from the each nozzle in accordance with the drive signal; and a temperature-difference-responsive controller which increases a first period of time taken for completing printing of a first amount when a difference in temperature between two places at least one of which is on the printhead exceeds a reference difference value which is a reference value of the temperature difference between the two places, the temperature-difference-responsive controller not increasing the first period of time when the temperature difference does not exceed the reference difference value.

2. The inkjet printer according to claim 1, wherein the reference difference value is such that when the temperature difference exceeds the reference difference value, an image printed by the inkjet printer suffers from an uneven print density perceivable by the eye, and when the temperature difference does not exceed the reference difference value, such an uneven print density does not occur.

3. The inkjet printer according to claim 1, wherein the reference difference value is such that when the temperature difference exceeds the reference difference value, an image printed by the inkjet printer suffers from at least one of: banding which is a band having a print density different from that of the other part of the image; and a white line which is a blank band produced by failure of ejection of ink droplets, and when the temperature difference does not exceeds the reference difference value, the image does not suffer from the banding and the white line.

4. The inkjet printer according to claim 1, wherein both of the two places are on the printhead.

5. The inkjet printer according to claim 4, wherein the reference difference value is selected from a range of 5° C. to 8° C.

6. The inkjet printer according to claim 5, wherein the reference difference value is 5° C.

7. The inkjet printer according to claim 1, wherein the two places are such that when a rise in the temperature of the printhead becomes constant after continued printing, the temperatures of the two places are respectively the highest and the lowest in the printhead.

8. The inkjet printer according to claim 1, wherein the first amount corresponds to a single page of the recording medium.

9. The inkjet printer according to claim 1, wherein the print data is constituted by a series of data units, and the printing of the first amount is performed based on a plurality of data units, and wherein the temperature-difference-responsive controller is adapted such that when the temperature difference exceeds the reference difference value, start of the printing of the first amount is deferred by a delay time.

10. The inkjet printer according to claim 9, further comprising a sucking portion which sucks the ink in the printhead through the nozzles, and wherein the temperature-difference-responsive controller makes the sucking portion to suck the ink in the printhead before the printing of the first amount is started, thereby spending at least a part of the delay time.

11. The inkjet printer according to claim 1, wherein the print data is constituted by a series of data units, and the printing of the first amount is performed based on a plurality of data units, and wherein the temperature-difference-responsive controller divides a delay time, which should be applied to the printing of the first amount to increase the first period of time, into a plurality of sub delay times, and defers start of printing based on each of the data units, by the sub delay time.

12. The inkjet printer according to claim 1, wherein when the temperature difference exceeds the reference difference value, the temperature-difference-responsive controller increases the first period of time, according to an amount by which the temperature difference exceeds the reference difference value.

13. The inkjet printer according to claim 1, wherein when the temperature difference exceeds the reference difference value, the temperature-difference-responsive controller increases the first period of time by printing a single raster by plural printing operations such that a fragment of the print data for the single raster is divided into a plurality of parts based on which the plural printing operations are respectively performed.

14. The inkjet printer according to claim 1, further comprising a temperature-responsive controller which increases a second period of time taken for completing printing of a second amount when the temperature of the printhead exceeds a reference temperature value which is a reference value of the temperature of the printhead, and does not increase the second period of time when the temperature does not exceed the reference temperature value.

15. The inkjet printer according to claim 1, wherein the print data is constituted by at least one data unit, and the printing of the first amount is performed based on the at least one data unit, wherein the temperature-difference-responsive controller comprises:

a consumption calculator which calculates an amount of ink consumed for completing the printing of the first amount; and a consumption-responsive deferrer which defers start of printing based on at least one of the at least one data unit constituting the print data for the printing of the first amount, when the ink consumption calculated by the consumption calculator takes such a value that indicates that the first period of time taken for completing the printing of the first amount should be increased.

16. The inkjet printer according to claim 15, wherein the consumption-responsive deferrer implements the deferring when the ink consumption calculated by the consumption calculator exceeds a reference consumption value which is a reference value of the ink consumption, the reference consumption value being such that when the printing of the first amount which consumes the ink of the reference consumption value is repeated, a difference in temperature between a first place near the IC chip and a second place far from the IC chip, as the two places, saturates at the reference difference value.

17. The inkjet printer according to claim 15, wherein the IC chip is disposed on one of opposite sides of the nozzle rows in a direction perpendicular to a direction of extension of each of the nozzle rows, and the consumption-responsive deferrer implements the deferring when the ink consumption calculated by the consumption calculator exceeds a reference consumption value which is a reference value of the ink consumption, the reference consumption value being such that when the printing of the first amount which consumes the ink of the reference consumption value is repeated, a difference in temperature between a third place and a fourth place, as the two places, saturates at the reference difference value, the third place corresponding to one of the nozzle rows which is the nearest the IC chip among all the nozzle rows while the fourth place corresponding to another of the nozzle rows which is the farthest from the IC chip.

18. The inkjet printer according to claim 17, wherein the nozzle rows extend parallel to one another, and the IC chip has an elongate shape extending substantially parallel to the nearest nozzle row.

19. The inkjet printer according to claim 15, wherein the consumption-responsive deferrer defers start of the printing of the first amount, once for all of the at least one data unit constituting the print data for the printing of the first amount.

20. The inkjet printer according to claim 15, wherein the print data is constituted by a series of data units, and the consumption-responsive deferrer divides a delay time which should be applied to the printing of the first amount to increase the first period of time, into a plurality of sub delay times, and defers start of printing based on each of the data units, by the sub delay time.

21. The inkjet printer according to claim 15, wherein the consumption-responsive deferrer includes a consumption comparer which makes a comparison between the ink consumption and a reference consumption value which is a reference value of the ink consumption, and changes the increase in the period of time taken for completing the printing of the first amount such that the increase is larger when the consumption comparer determines that the ink consumption exceeds the reference consumption value by a relatively large amount than when the consumption comparer determines that the ink consumption exceeds the reference consumption value by a relatively small amount.

22. The inkjet printer according to claim 15, wherein the consumption-responsive deferrer includes a consumption comparer which makes a comparison between the ink consumption and a reference consumption value which is a reference value of the ink consumption, and the printing of the first amount is continuously repeated without intermission when the ink consumption does not exceed the reference consumption value.

23. The inkjet printer according to claim 1, wherein the temperature-difference-responsive controller comprises:

a variable changer which changes a variable associated with the temperature difference between the two places, based on at least an amount of ink consumed for completing the printing of the first amount; and a variable-responsive controller which increases the first period of time taken for completing the printing of the first amount, when the variable changed by the variable changer exceeds a reference value thereof which is associated with the reference temperature difference.

24. The inkjet printer according to claim 23, wherein the variable changer decreases the variable with the increase in the first period of time by the variable-responsive controller.

25. The inkjet printer according to claim 24, wherein the variable changer determines the amount of the decrease in the variable such that the amount of the decrease is larger when the increase in the period of time by the variable-responsive controller is relatively large than when the increase in the period of time is relatively small.

26. The inkjet printer according to claim 23, wherein both of the two places are on the printhead.

27. The inkjet printer according to claim 23, wherein the first amount corresponds to a single page of the recording medium.

and wherein the variable changer determines an amount of increase in the variable, according to the ink consumption for the printing of the single page, and determines an amount of the decrease in the variable by the variable-responsive controller, according to the increase in the first period of time taken for completing the printing of the single page.

28. The inkjet printer according to claim 23, wherein the variable changer includes a measurer which measures the temperature of an environment in which the inkjet printer rests, and changes the variable with weighting based on the measured environmental temperature.

29. The inkjet printer according to claim 23, wherein the nozzle rows extend parallel to one another and the IC chip is disposed on one of opposite sides of the nozzle rows in a direction perpendicular to a direction of extension of each of the nozzle rows, the IC chip having an elongate shape extending substantially parallel to the nozzle rows, the reference value of the variable corresponds to a difference in temperature between a third place corresponding to the nearest nozzle row and a fourth place corresponding to another of the nozzle rows which is the farthest from the IC chip.

30. The inkjet printer according to claim 23, wherein the IC chip is disposed on the external side of one ends of the respective nozzle rows on the most downstream side with respect to supply of the ink to the printhead, and wherein the reference value of the variable corresponds to a difference in temperature between a fifth place corresponding to ends of the respective nozzle rows on the uppermost stream side with respect to the ink supply, and a sixth place corresponding-to the opposite ends of the respective nozzle rows on the most downstream side with respect to the ink supply.

31. The inkjet printer according to claim 23, wherein when the variable changed by the variable changer does not exceed the reference value of the variable, the variable-responsive controller does not increase the first period of time taken for completing the printing of the first amount and the printing of the first amount is continuously repeated without intermission.

* * * * *